US010323853B2

(12) United States Patent
Zakula et al.

(10) Patent No.: US 10,323,853 B2
(45) Date of Patent: Jun. 18, 2019

(54) VENTILATION SYSTEM AND METHOD

(71) Applicant: Broan-NuTone LLC, Hartford, WI (US)

(72) Inventors: Mirko Zakula, New Berlin, WI (US); Robert G. Penlesky, Waukesha, WI (US); Daniel L. Karst, Beaver Dam, WI (US)

(73) Assignee: Broan-NuTone LLC, Hartford, WI (US)

( * ) Notice: Subject to any disclaimer, the term of this patent is extended or adjusted under 35 U.S.C. 154(b) by 960 days.

(21) Appl. No.: 13/956,125

(22) Filed: Jul. 31, 2013

(65) Prior Publication Data

US 2015/0038070 A1 Feb. 5, 2015

(51) Int. Cl.

| | |
|---|---|
| ***F24F 7/06*** | (2006.01) |
| ***F04D 29/42*** | (2006.01) |
| ***F04D 29/44*** | (2006.01) |

(52) U.S. Cl.

CPC ..... *F24F 7/065* (2013.01); *F04D 29/4226* (2013.01); *F04D 29/441* (2013.01)

(58) Field of Classification Search

CPC ... F24C 15/20; F24F 7/007; F24F 7/02; F24F 7/065; F24F 7/65; A01G 9/24; F04D 29/441; F04D 29/4226; F04D 29/4233

USPC ..... 415/204, 129; 454/306, 239, 249, 341, 454/347, 370

See application file for complete search history.

(56) References Cited

U.S. PATENT DOCUMENTS

| | | | | |
|---|---|---|---|---|
| 3,469,772 A * | 9/1969 | McDonald | F04D 17/162 415/198.1 |
| 5,120,193 A | 6/1992 | Kadle et al. | |
| 5,199,846 A | 4/1993 | Fukasaku et al. | |
| 5,997,246 A * | 12/1999 | Humbad | F04D 29/667 415/119 |

(Continued)

FOREIGN PATENT DOCUMENTS

| | | |
|---|---|---|
| EP | 2131041 | 12/2009 |
| JP | 11-091334 | 6/1999 |

OTHER PUBLICATIONS

Axair, Forward Curved Centrifugal Fans—Single inlet—standard motor, https://web.archive.org/web/20120702205320/http://www.axair-fans.co.uk/centrifugal-fans/forward-curved-centrifugal-fans-single-inlet-standard-motor.html, Jul. 2, 2012.*

*Primary Examiner* — Gregory L Huson
*Assistant Examiner* — Dana K Tighe
(74) *Attorney, Agent, or Firm* — Barnes & Thornburg LLP

(57) ABSTRACT

Embodiments of the invention provide a ventilation assembly including a scroll assembly that can include a blower assembly including a motor coupled to a blower wheel. Some embodiments include a discharge grid capable of being coupled to the scroll using a coupling pin or snap tabs. In some embodiments, the discharge grid includes a plurality of vertical and horizontal fins, and an outlet restriction. In some embodiments, at least one of the plurality of horizontal fins extends from the outlet restriction to couple with at least one vertical fin to form an aperture. In other embodiments, at least a portion of at least one of the plurality of vertical and horizontal fins includes a flared surface. Some embodiments include a scroll assembly that includes a scroll crescent. In some embodiments, a scroll including a dis- (Continued)

charge grid and scroll crescent can at least partially guide a fluid within the ventilation assembly.

40 Claims, 34 Drawing Sheets

(56) References Cited

U.S. PATENT DOCUMENTS

| | | | | |
|---|---|---|---|---|
| 6,168,378 | B1 * | 1/2001 | Craw | F04D 29/441 415/211.2 |
| 6,595,146 | B2 | 7/2003 | Gatley, Jr. | |
| 6,821,088 | B2 | 11/2004 | Sakai et al. | |
| 7,033,137 | B2 | 4/2006 | Shufeldt | |
| 7,566,263 | B2 * | 7/2009 | Snyder | E04F 19/083 454/284 |
| 7,785,064 | B2 * | 8/2010 | Bartholmey | F04D 29/4246 415/1 |
| 2012/0211205 | A1 | 8/2012 | Eguchi et al. | |

* cited by examiner

VENTILATION SYSTEM AND METHOD

BACKGROUND

Ventilating exhaust fans, such as those typically installed in bathrooms, draw air from within an area and pass the exhausted air out to another location, such as through a vent in the gable or roof of a home or other building structure. The exhaust fan is usually positioned adjacent an aperture in a wall or ceiling, and secured in a number of conventional manners, such as by being attached to wall or ceiling joists, or by being attached to another other structure in the wall or ceiling. Centrifugal exhaust fans typically include a rotating fan wheel having a plurality of vanes that create an outward airflow which, in turn, is directed out of an outlet opening. The fan wheel is typically coupled to a motor supported within the fan housing, and the motor drives the fan wheel, thus providing ventilation to an area. In some cases, a curved fan scroll is employed to channel air around the fan, and can be defined by a housing wall of the fan or by a separate element within the fan housing. During operation, most modern ventilating exhaust fans do not run silently. The noise emission and audible noise can depend on a variety of factors, including but not limited to the size and type of motor, the fan wheel and/or scroll design and the size, and shape of the ventilation inlet and outlet.

SUMMARY

Some embodiments of the invention provide a ventilation assembly including a discharge grid. In some embodiments, the discharge grid comprises an outlet restriction, including a restriction wall with an inner surface and a first edge and a second edge. In some embodiments, the discharge grid comprises a plurality of vertical fins and horizontal fins. In some embodiments, the discharge grid includes a main wall coupled to the first edge and the inner surface. The main wall includes a first end and a second end and first and second surfaces.

In some embodiments, the plurality of vertical fins includes a first vertical fin including a top edge and a bottom edge. In some embodiments, the bottom edge of the first vertical fin is coupled to the restriction wall at the second edge and the inner surface. In some embodiments, a plurality of horizontal fins are coupled to the second surface of the main wall and the inner surface of the restriction wall and the first vertical fin. In some embodiments, at least one of the plurality of horizontal fins extends from the outlet restriction to couple with at least one other vertical fin and form at least one aperture. Some embodiments also include a base wall coupled to the second end of the main wall and the bottom edge of the first vertical fin.

Some embodiments provide a ventilation assembly including a scroll assembly. In some embodiments, the scroll assembly comprises a scroll housing including an inner scroll surface. In some further embodiments, the scroll assembly includes a scroll crescent including a first crescent end and a second crescent end. In some embodiments, the scroll crescent can include a substantially incurvated surface, and a substantially convex surface coupled to the inner scroll surface of the scroll housing. In some embodiments, the substantially convex surface is coupled to the first crescent end and the second crescent end and the substantially incurvated surface. Some embodiments include a ventilation assembly with a scroll crescent that is integrally formed with the inner scroll surface of the scroll housing. In other embodiments, the scroll crescent comprises a discrete component coupled to the inner scroll surface of the scroll housing. Some further embodiments of the ventilation assembly include a blower assembly including a motor coupled to a blower wheel.

In some embodiments of the ventilation assembly, at least a portion of at least one of the plurality of vertical fins includes a flared surface. In some other embodiments, at least a portion of at least one of the plurality of horizontal fins includes a flared surface. Some embodiments include one or more flared surface surfaces that include a flare bottom surface comprising a flare bottom length, and a flare top surface comprising a flare top length. In some embodiments, the flare top surface and flare bottom surface is at least partially curved. In some embodiments, the flare top length and flare bottom length is substantially equal, whereas in other embodiments, the flare top length and flare bottom length are unequal.

Some embodiments include a discharge grid comprising at least one coupling pin. In some embodiments, the discharge grid is configured and arranged to be coupled to the scroll by coupling the at least one coupling pin with at least one scroll pin coupling hole.

Some embodiments include a discharge grid with at least one fastener coupling hole and the scroll includes at least one scroll fastener coupling hole. In some embodiments, the discharge grid is further configured and arranged to be coupled to the scroll using at least one fastener secured through the at least one fastener coupling hole and through at least one scroll fastener coupling hole.

Some embodiments include a discharge grid that further includes a flange coupled to the main wall. In some embodiments, the flange includes a coupling edge including at least one snap tab. Some embodiments also include a base wall that includes at least one snap tab. In some embodiments, the scroll includes at least one snap slot and at least one vertical slot and at least one snap slot. In some embodiments, the discharge grid is secured to the scroll by coupling the at least one snap tab with the at least one snap slot. In other embodiments, the discharge grid is secured to the scroll by coupling the coupling edge with the vertical slot. In some further embodiments, the discharge grid is secured to the scroll by coupling the at least one snap tab with the at least one snap slot and by coupling the coupling edge with the vertical slot.

In some embodiments, the scroll crescent is positioned within the scroll so that the scroll crescent is positioned within the scroll with the first crescent end substantially 80° or more from the first wall of the inner scroll surface. In some further embodiments, the scroll crescent is positioned within the scroll so that the second crescent end is substantially 170° or less from the first wall of the inner scroll surface. In some other embodiments, the scroll crescent is positioned within the scroll so that the first crescent end is positioned substantially at 90° from the first wall of the inner scroll surface, and the second crescent end is substantially at 180° from the first wall of the inner scroll surface.

Some embodiments include a ventilation assembly where at least one of the plurality of vertical fins and at least one the plurality of horizontal fins form at least one perpendicular intersection. In some embodiments, the discharge grid is configured and arranged to guide air exiting the scroll housing in at least two different directions.

DETAILED DESCRIPTION

Figure 1A:
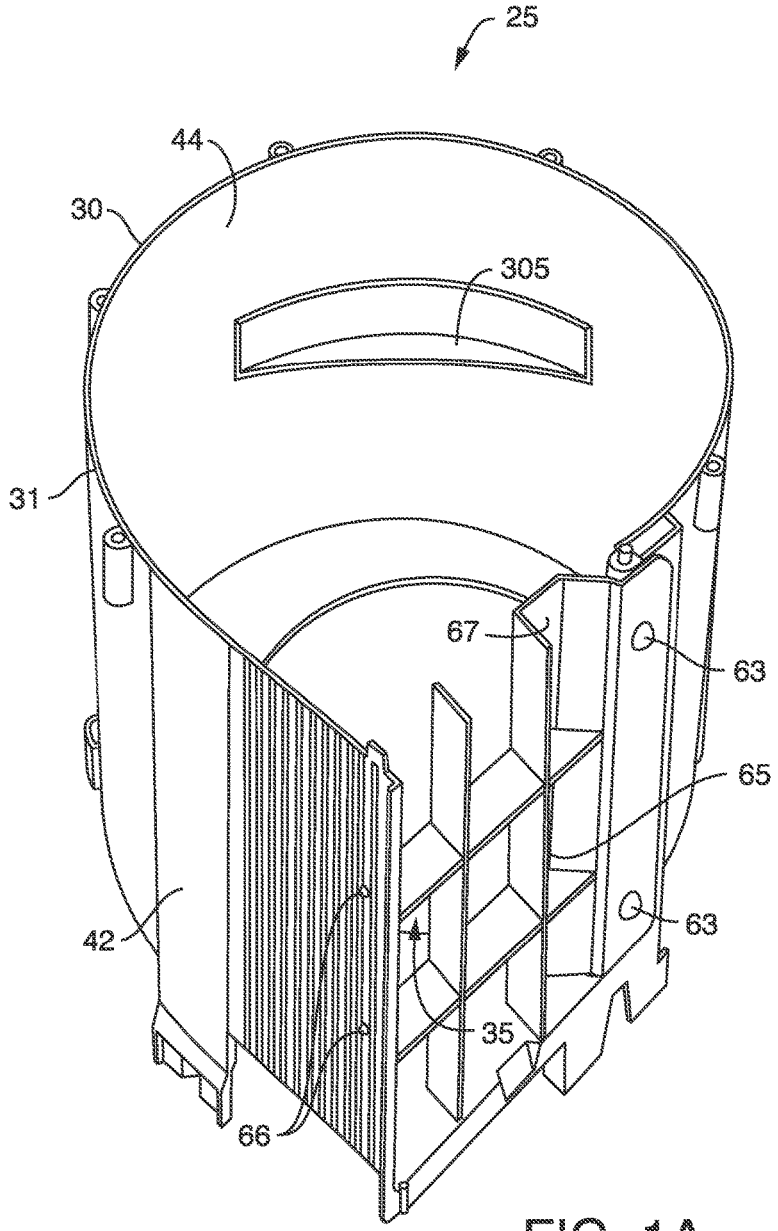
FIGS. 1A-D show perspective views of a scroll assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

In some embodiments, the ventilation assembly 10 can be used to ventilate any room, area or space. In some embodiments, the ventilation assembly 10 can be secured within a wall, ceiling, or other building structure in a partially, or fully recessed position. In some embodiments, the ventilation assembly 10 can be installed within an intermediate space, outside of the room, area or space, and coupled with one or more ventilation duct assemblies to extract a fluid from the room, area or space. In some other embodiments, the fluid may comprise air, or other gases, or vapor, such as water vapor. In some embodiments, the fluid may comprise smoke, ash, or other particulate in addition to air or other gases.

In some embodiments, the ventilation assembly 10 can be installed as a new, original equipment installation in a room or building where none had previously existed, whereas some embodiments of the invention provide a ventilation assembly 10 that can replace a pre-existing ventilation system. In some embodiments, the assembly 10, can be installed as a new, or a replacement ventilation system, and in some embodiments, the assembly 10 can replace an existing assembly 10.

Figure 10A:
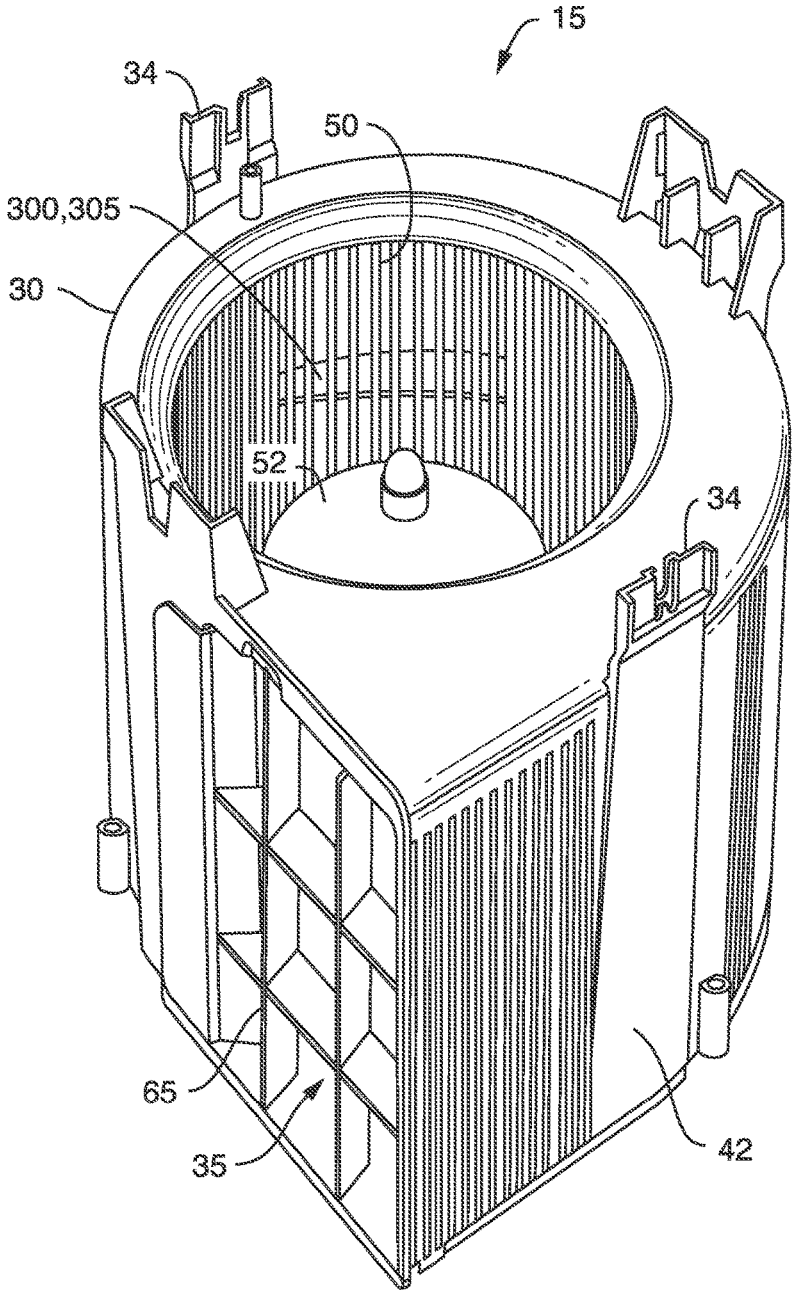
FIG. 10A illustrates a perspective view of a blower assembly according to one embodiment of the invention.

Some embodiments of the ventilation assembly 10 can include several components and devices that can perform various functions. In some embodiments, the ventilation assembly 10 can include a housing 20, which can house the various components and devices of the ventilation assembly 10. For example, in some embodiments the ventilation assembly 10 can generally include the blower assembly 15 as shown in FIG. 10A. In some embodiments, the blower assembly 15 can be substantially housed within the housing 20, and positioned and anchored to the housing 20 aided by at least one retention feature 34. In some embodiments, the blower assembly 15 can generally include motor 52 (for example a permanent split capacitor motor), and may include a conventional motor capacitor (not shown). Some embodiments provide a blower assembly 15 that can also include a scroll 30 comprising a scroll housing 31 including an inner surface 44 formed between a first wall 45*a* and a second wall 45*b*, and a blower wheel 50 positioned substantially within the scroll 30 and mechanically coupled to the motor 52. In some embodiments, the motor 52 is electrically coupled to a conventional motor power harness (not shown).

In some embodiments, the ventilation assembly 10 includes a duct connector assembly 58 (shown in FIG. 10B) configured and arranged for coupling with a conventional ventilation orifice (not shown). In some embodiments, the duct connector assembly 58 can include a damper flap 60 that is coupled with the ventilation orifice 62. Some embodiments can include a duct connector assembly 58 including a damper flap 60 that is capable of being moved within the ventilation orifice 62 to substantially control the backflow of a fluid into the ventilation orifice 62. Furthermore, in some embodiments, the duct connector assembly 58 is further capable of substantially controlling the flow of fluid from a space into the ventilation of a duct of building (not shown) when the motor 52 is unpowered.

In some embodiments, the scroll 30 can be formed into any shape, but generally is shaped to provide a substantially laminar fluid flow towards a discharge outlet 35. In one embodiment, the discharge outlet can be defined at least partially by a first wall 35*a* and a second wall 35*b* opposing the first wall 35*a*. In some embodiments, the first and second opposing walls 35*a*, 35*b* can extend from a top 35*d* of the discharge outlet 35 to a bottom 35*c* of the discharge outlet 35. The scroll 30 may be formed from any material that is readily shaped, including, but not limited to, polymers, polymer-composites, metal, ceramic, or wood, or paper-based composite or laminate. Furthermore, the use of injection-molded or thermo-formed polymeric materials conveniently allows a variety of functional or aesthetic components to be included into the structure of the scroll 30. In some embodiments, one or more functional or aesthetic components can be integrally formed within the scroll 30 using one or more thermoplastic polymers and injection-molding technology, thermo-molding or other molding technology. In other embodiments, one or more thermosetting polymer precursors may be used with a thermo-molding or other molding technology.

In some other embodiments, the use of injection-molded or thermo-formed polymeric materials conveniently allows a variety of functional or aesthetic components to be included and formed as discrete components, and then attached to the scroll 30 using adhesive, fasteners, thermo-molding or other melt-attachment process. In some embodiments, one or more functional and/or aesthetic components can be formed and then later attached to the scroll 30 using one or more thermoplastic polymers and injection-molding technology, thermo-molding or other molding technology. In other embodiments, one or more thermosetting polymer precursors may be used with a thermo-molding or other molding technology to form a component and then later attached to the scroll 30. In some other embodiments, the scroll 30 may utilize a combination of integrally formed and discrete components attached to the scroll 30.

In some embodiments, the main housing 20 may be formed into any shape, included but limited to, a rectangular box-like shape, an oval shape, a hemispherical shape, a spherical shape, a pyramidal shape, or any other shape. In some embodiments the main housing 20 is formed from a sheet metal, including, but not limited to an aluminum-based metal, a steel or iron-based metal, a zinc-based metal, or a nickel and tin-based metal. In some other embodiments, the main housing 20 may be formed from injection molded polymers, thermo-formed polymers, thermosetting polymers, or sheet metal, or any other suitable material. In some other embodiments, the housing 20 may comprises a wood-based product, such as wood, or particle-board or wood laminate. In some other embodiments, the housing 20 can form a base or a similar support structure of the ventilation assembly 10.

Some embodiments can include at least one component suitable for modifiying a flow of fluid within the scroll assembly 25. In some embodiments, this can include the addition of at least one component that can reduce noise creation with the main housing 20. For example, some embodiments include at least one noise reduction feature 65, 300, 305. For example, some embodiments of the scroll assembly 25 include a discharge grid 65. For example, as shown in the various perspective views of a scroll assembly according to one embodiment in the FIGS. 1A-1B and 2A-2B, in some embodiments, a discharge grid 65 can be positioned at the discharge outlet 35 and attached to the scroll 30 to form a scroll assembly 25. In some embodiments, the discharge grid 65 may be formed from any material that is readily shaped, including, but not limited to, polymers, polymer-composites, metal, ceramic, or wood, or paper-based composite or laminate, or metals. In some embodiments, the use of injection-molded or thermo-formed polymeric materials conveniently allows a variety of functional or aesthetic features to be included into the structure of the discharge grid 65. In some embodiments, one or more functional or aesthetic components can be integrally formed within the discharge grid 65 using one or more thermoplastic polymers and injection-molding technology, thermo-molding or other molding technology. In other embodiments, one or more thermosetting polymer precursors may be used with a thermo-molding or other molding technology. In some other embodiments, the use of injection-molded or thermo-formed polymeric materials conveniently allows the discharge grid 65 to be formed integral with the scroll 30. In some other embodiments, the discharge grid 65 can be formed as a discrete component and then later attached to the scroll 30.

In some embodiments the discharge grid 65 can include one or more structures designed to at least partially obstruct fluid flow. For example, in some embodiments, the discharge grid 65 can include an outlet restriction 67. In some embodiments, the outlet restriction 67 can be integrally formed with the discharge grid 65, and in other embodiments, the the outlet restriction 67 can be formed as a discrete component and assembled with the discharge grid 65.

Figure 1B:
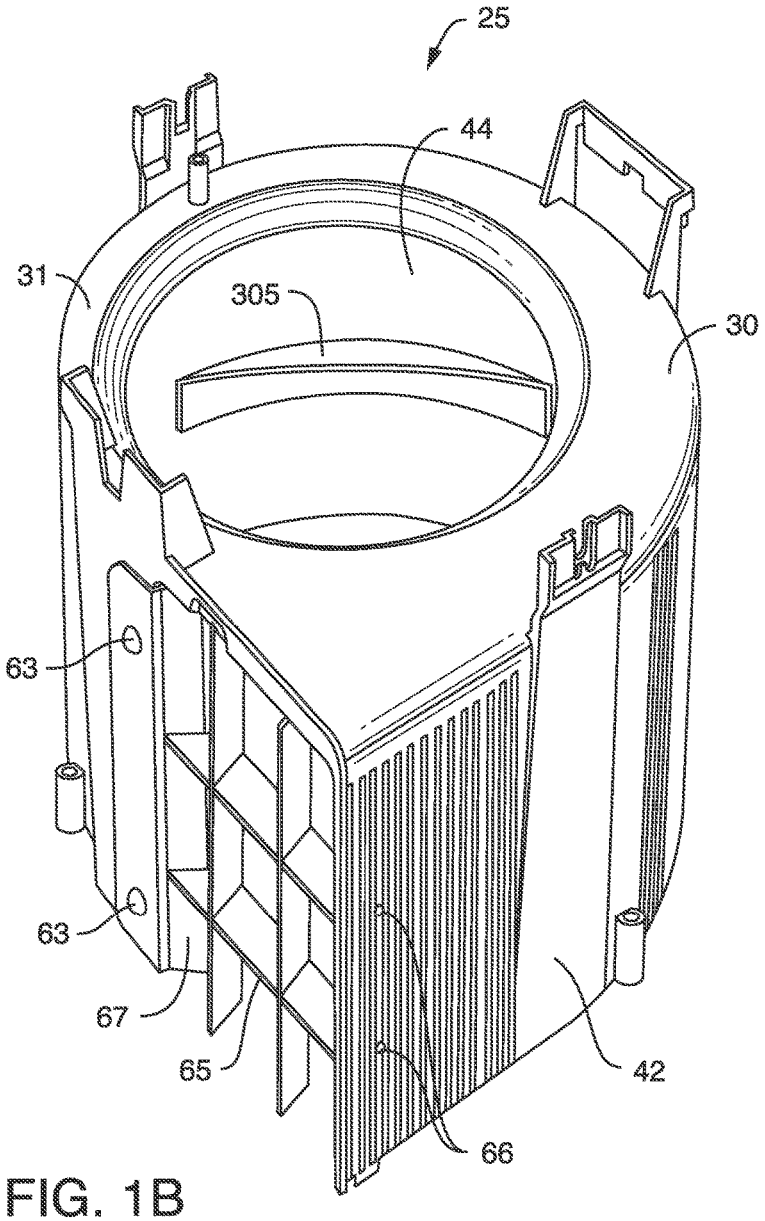
Figure 1C:
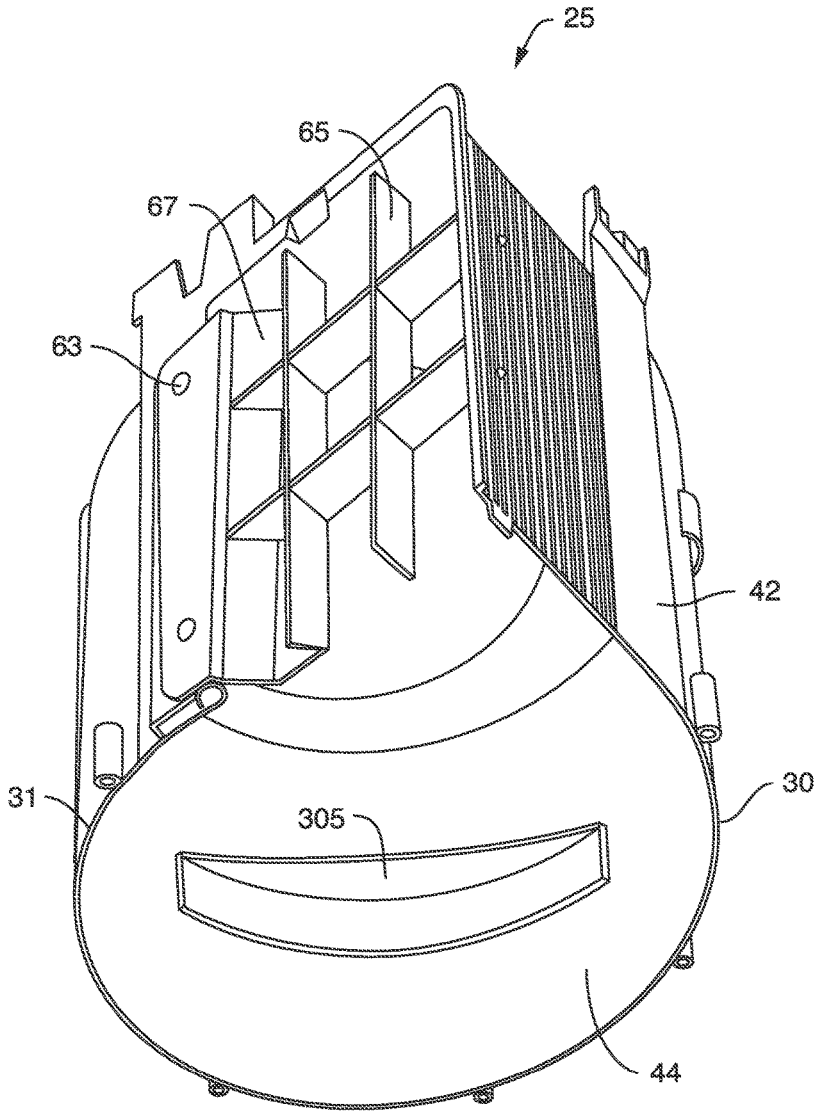

As shown in FIGS. 1A-1C, in some embodiments, the discharge grid 65 can be coupled to the scroll using at least one pin 66. Further, as shown in FIGS. 9E-9H, in some embodiments, the grid 65 can include at least one coupling pin 66. As shown, in some embodiments, the first horizontal fin 90 and the second horizontal fin 100 can include a coupling pin 66. In some embodiments, the discharge grid 65 can be secured to the scroll 30 by inserting the pins 66 of the grid 65 into pin coupling holes 66*a* within the body of the scroll 30 (see for example the holes 66*a* in FIG. 1E).

Figure 1D:
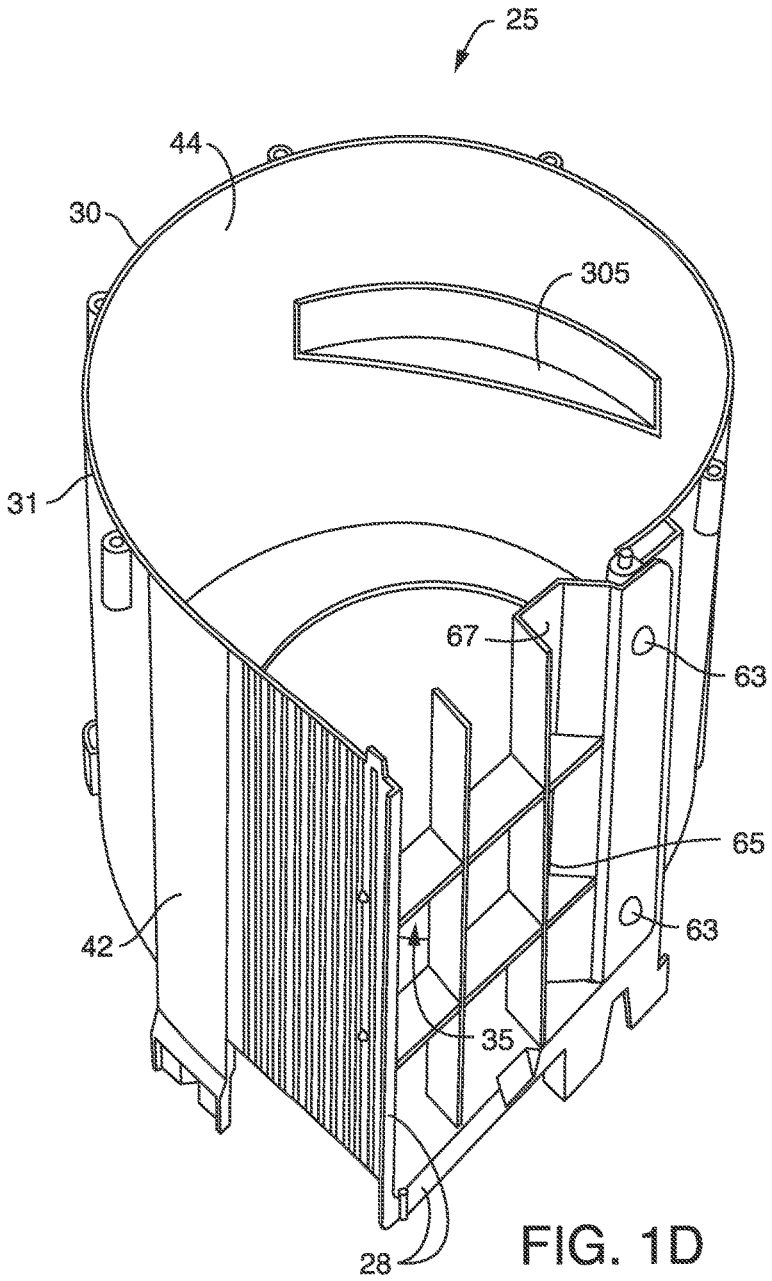
Figure 1E:
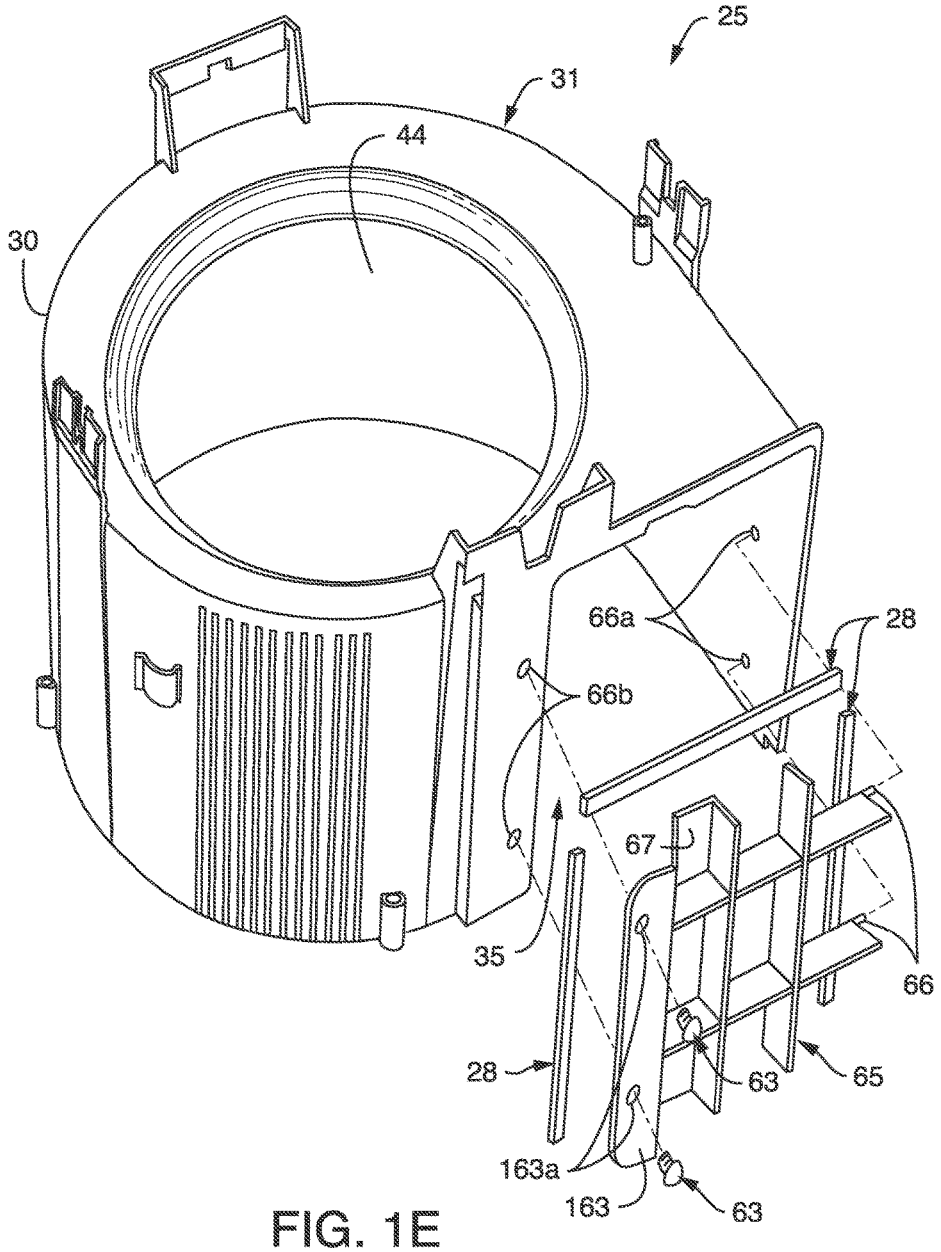
FIG. 1E shows an assembly view of a scroll assembly according to one embodiment of the invention.

Some embodiments include a scroll gasket 28. In some embodiments, one or more scroll gaskets 28 can be applied to the scroll housing 31 to at least partially surround the discharge outlet 35 as shown in FIG. 1D-1E. In some embodiments, the one or more scroll gaskets 28 can provide a seal for coupling with at least one other component of the ventilation assembly 10, such as the duct connector assembly 58 and/or the housing 20. In some embodiments, the scroll gaskets 28 can provide vibration isolation and reduce noise.

In some embodiments, as fluid flows within the scroll 30 and approaches the outlet 35, the outlet restriction 67 can at least partially impede the flow of fluid within the scroll 30. Some embodiments include an outlet restriction 67 with a restriction wall (130 in FIGS. 4A-4C) that can at least partially change the flow of fluid within the scroll 30.

Figure 7A:
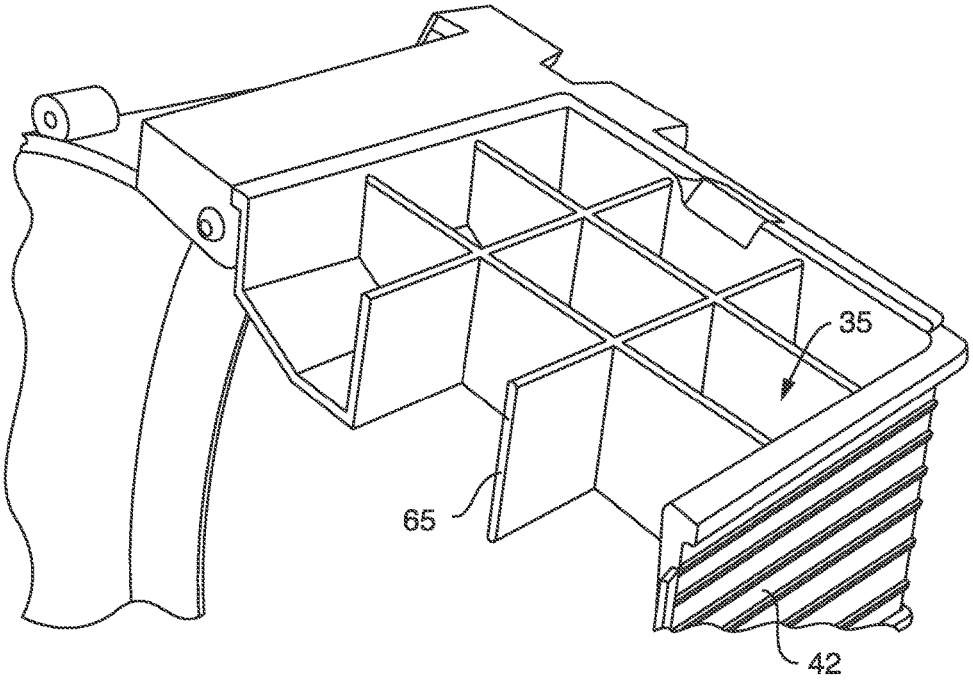
FIG. 7A is a partial perspective view of a discharge grid assembled into a scroll according to one embodiment of the invention.

Some embodiments of the invention include a discharge grid 65 including an outlet restriction 67 that includes a main wall 150, including a first end 150*a*, a second end 150*b*, and several surfaces including a first surface 150*c*, and a second surface 150*d*. In some embodiments, the outlet restriction 67 includes a restriction wall 130. In some embodiments, the restriction wall 130 includes a first wall 135 coupled to a second wall 140. In some embodiments, the second wall 140 is further coupled to the main wall 150. A base wall 170 is coupled to the main wall 150 and the restriction wall 130 in some embodiments. In some embodiments, the base wall includes a first end 170*a*, a second end 170*b*, a top base edge 170*c*, and a bottom base edge 170*d*. In some embodiments, the first end 170*a* is coupled with the second end 150*b* at the second surface 150*d*, and the bottom base edge 170*d* is coupled with the restriction wall 130. In some further embodiments, the second end 170*b* of the base wall 170 is coupled to a first vertical fin 80. As depicted, for example, in FIG. 4B, the first vertical fin 80 comprises a top edge 81*a* and a bottom edge 81*b*. As can be seen, for example, in FIG. 7A, the bottom edge 81*b* of the first vertical fin 80 is configured to be located upstream of the top edge 81*a* of the first vertical fin 80 when the discharge grid 65 is located in the discharge outlet 35. The first wall 135 of the restriction wall 130 extends from the bottom edge 81*b* of the first vertical fin 80 to the second wall 140 of the restriction wall 130, which extends to the main wall 150. As depicted in FIGS. 3C and 7A, because the first wall 135 extends from the upstream, bottom edge 81*b* of the first vertical fin 80 the first wall 135 of the restriction wall 130 is located at the upstream edge of the first vertical fin 80. Therefore, when the discharge grid 65 is located in the discharge outlet 35, the first wall 135 of the restriction wall 130 is located upstream of the discharge outlet 35. Moreover, when the discharge grid 65 is located in the discharge outlet 35, the restriction wall 67 extends from adjacent one of the first and second opposing walls 35*a*, 35*b* defining the discharge outlet 35 and substantially between the top 35*d* and bottom 35*c* of the discharge outlet 35.

In some embodiments, as fluid flows within the scroll 30 and approaches the outlet 35, the outlet restriction 67 can at least partially substantially block the flow of fluid within the scroll 30. In some embodiments, the outlet restriction wall 67 can extend inward from the discharge outlet 35 of the scroll 30 toward the blower wheel 50 as depicted, for example, in FIGS. 1A, 1C, 1D, 7A. In other embodiments, the outlet restriction 67 can at least partially redirect and/or modify the velocity profile of the flow of fluid within the scroll 30. In embodiments where the scroll 30 at least partially impedes, blocks, or redirects and/or modifies the velocity of fluid flow within the scroll, the outlet restriction 67 can at least partially prevent or reduce fluid vortices 505 within the scroll 30.

Figure 2A:
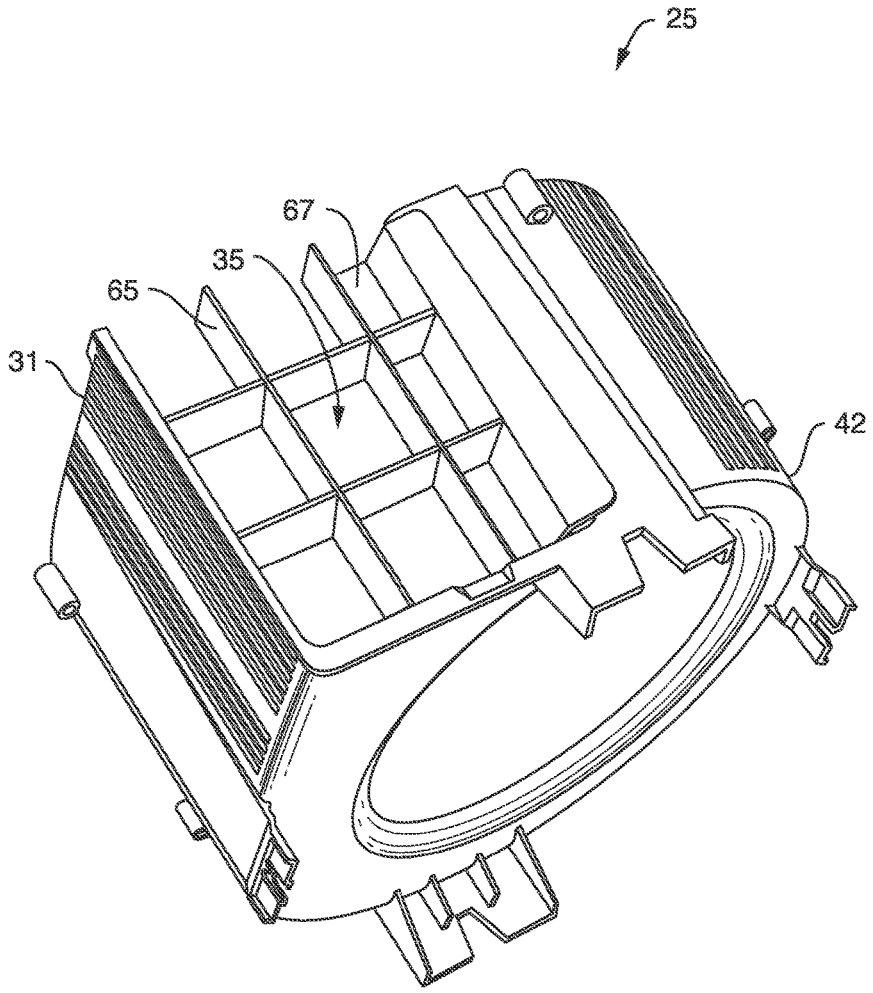
FIGS. 2A-C shows perspective views of a scroll assembly according to another embodiment of the invention.
Figure 2B:
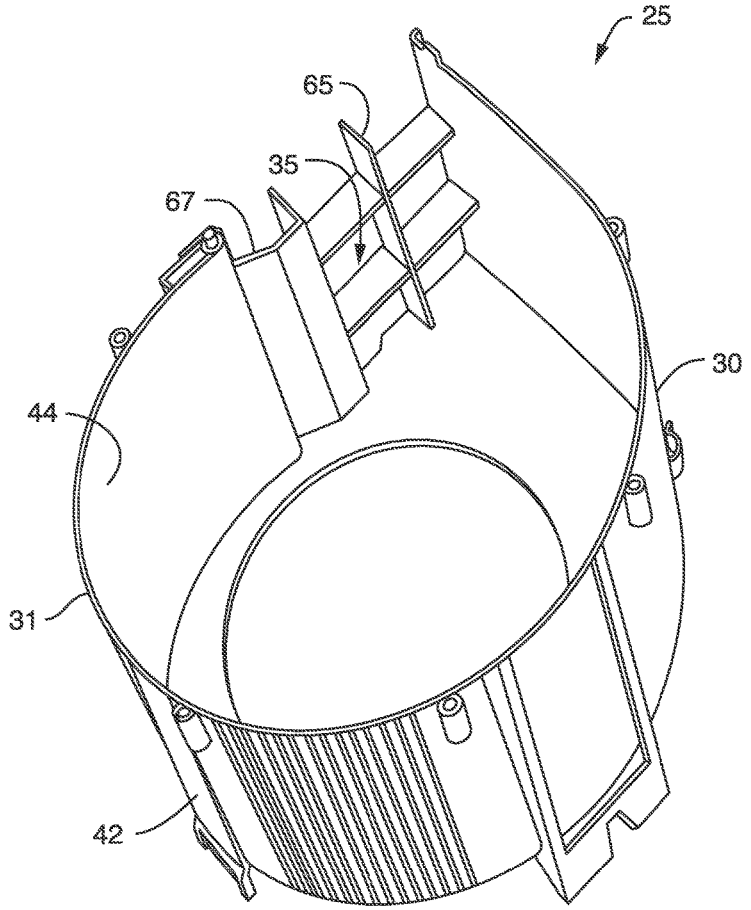
Figure 2C:
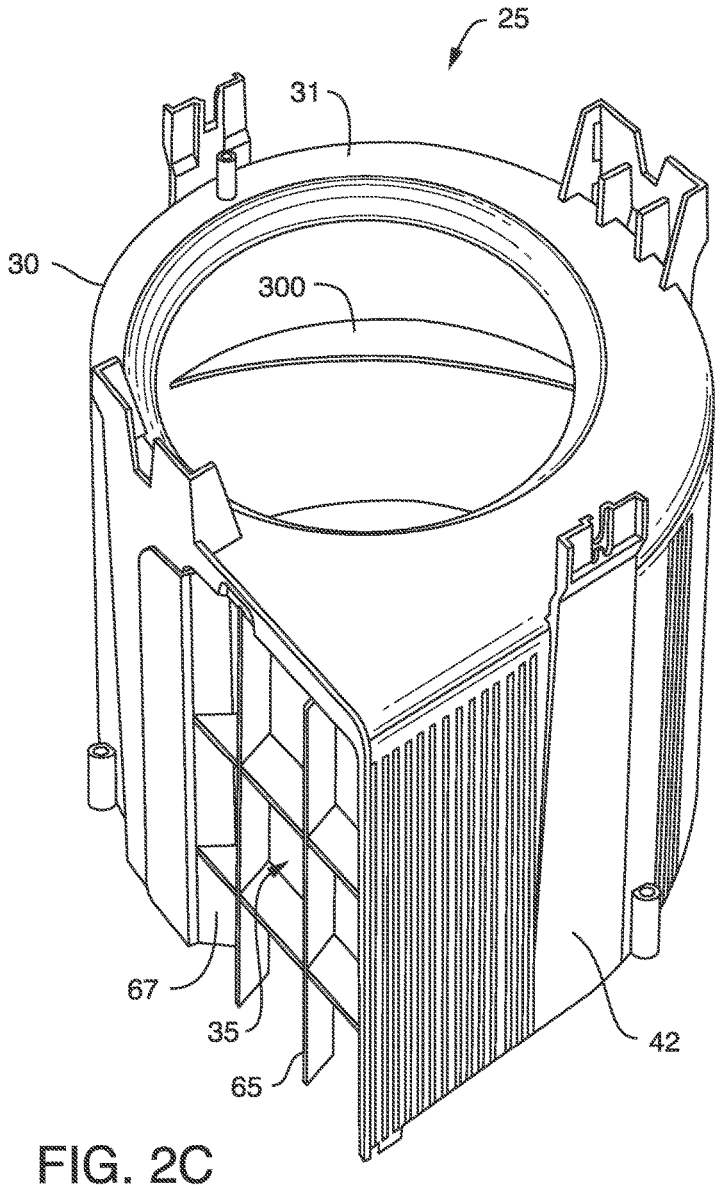

Some embodiments can include other features designed to change, or otherwise guide the flow of fluid within the scroll 30. In some embodiments, one or more structures can be included in the scroll 30 to change the flow of a fluid prior to contact with the discharge grid 65. For example, FIGS. 1A-D show perspective views of a scroll assembly 25 according to one embodiment of the invention, and FIGS. 2A-C shows perspective views of a scroll assembly 25 according to another embodiment of the invention. In some embodiments, one or more structures as illustrated in FIGS. 1A-D and 2A-C can reduce the noise emitted by the flow of fluid within the scroll 30 either alone, or in combination with the discharge grid 65 including the outlet restriction 67.

Figure 3A:
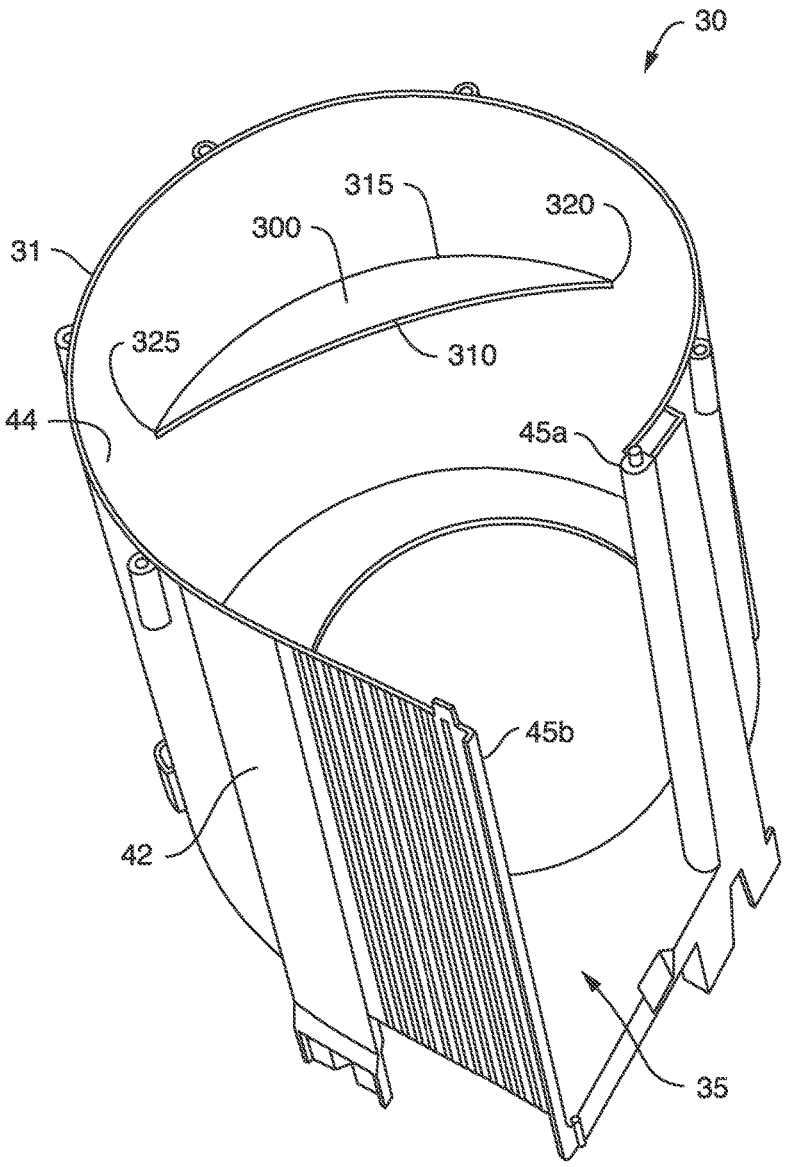
FIGS. 3A-C show perspective views of a scroll assembly according to one embodiment of the invention.

As shown in FIG. 3A, in one embodiment of the invention, a scroll 30 can include a scroll housing 31 comprising an inner scroll surface 44 and an outer surface 42, and can include a scroll crescent 300. Some embodiments include at least one scroll crescent 300 located within the scroll 30 substantially integral with the inner scroll surface 44 (for example, see 300 in FIG. 1B, 2C, 3A-3B). In other embodiments, the scroll 30 can include at least one scroll crescent 305 substantially adjacent to the inner scroll surface 44 as a discrete component coupled to the scroll 30 (for example, see the scroll crescent 305 in FIGS. 1A and 3C). As shown in FIG. 3D, in some embodiments, the scroll crescent 305 includes studs 307, and the scroll 30 includes holes 307*a*. In some embodiments, the scroll crescent 305 is coupled to the scroll 30 by inserting the studs 307 into the holes 307 as depicted by the assembly view shown in FIG. 3D. Further, in some embodiments, after the studs have been inserted into the holes 307, push-nuts 307*b* are pushed over the studs 307 to prevent the scroll crescent 305 from moving or rattling.

In some embodiments, the scroll crescent 300, 305 is positioned within the scroll 30 so that the first crescent end 320 and the second crescent end 325 are substantially within a quadrant 350 at least partially diagonally opposite a discharge out 35 of the scroll 30. For example, as shown in FIG. 3C, in some embodiments, the scroll crescent 305 (and equally applying to the scroll crescent 300 shown in FIG. 3B) can be substantially within the quadrant 350 of the scroll housing 31. As shown, the quadrant 350 is substantially diagonally opposite a discharge outlet 35. In some embodiments, the first crescent end and the second crescent may extend to encompass about 90 degrees of the quadrant 350, whereas in other embodiments, the first crescent end and the second crescent may extend to less than 90 degrees of the quadrant, but may be positioned anywhere within the quadrant 350. Moreover, as shown in FIGS. 3A and 3C, the scroll crescent be positioned substantially within the scroll 30 so that the first crescent end 320 is substantially 80° or more from the first wall 45*a* of the inner scroll surface 44, and the second crescent end 325 is substantially 170° or less from the first wall 45*a* of the inner scroll surface 44. In some other embodiments, the first crescent end 320 can be positioned substantially at 90° from the first wall 45*a* of the inner scroll surface 44, and the second crescent end can be positioned 180° from the first wall 45*a* of the inner scroll surface 44.

In some embodiments, the scroll crescent 300, 305 may be formed from any material that can be readily shaped, including, but not limited to, polymers, polymer-composites, metal, ceramic, or wood, or paper-based composite or laminate, or metals. In some embodiments, the use of injection-molded or thermo-formed polymeric materials conveniently allows the scroll crescent 300 to be integrally formed with the scroll housing 31. In other embodiments, one or more thermosetting polymer precursors may be used with a thermo-molding or other molding technology of the scroll housing 31 with scroll crescent 300. In some further embodiments, the scroll crescent 305 can be formed as a discrete component and then later attached to the scroll 30.

Some embodiments include a scroll crescent 305 formed from substantially the same material as the scroll housing 31. In some embodiments, the scroll crescent 305 may be formed from polymers, polymer-composites, metal, ceramic, or wood, or paper-based composite or laminate, or metals. In some embodiments, the scroll crescent 305 can be injection-molded or thermo-formed, thermo-molding or otherwise formed separately from the formation of the scroll 30, and later secured to the inner scroll surface 44 of the scroll housing 31.

Figure 3B:
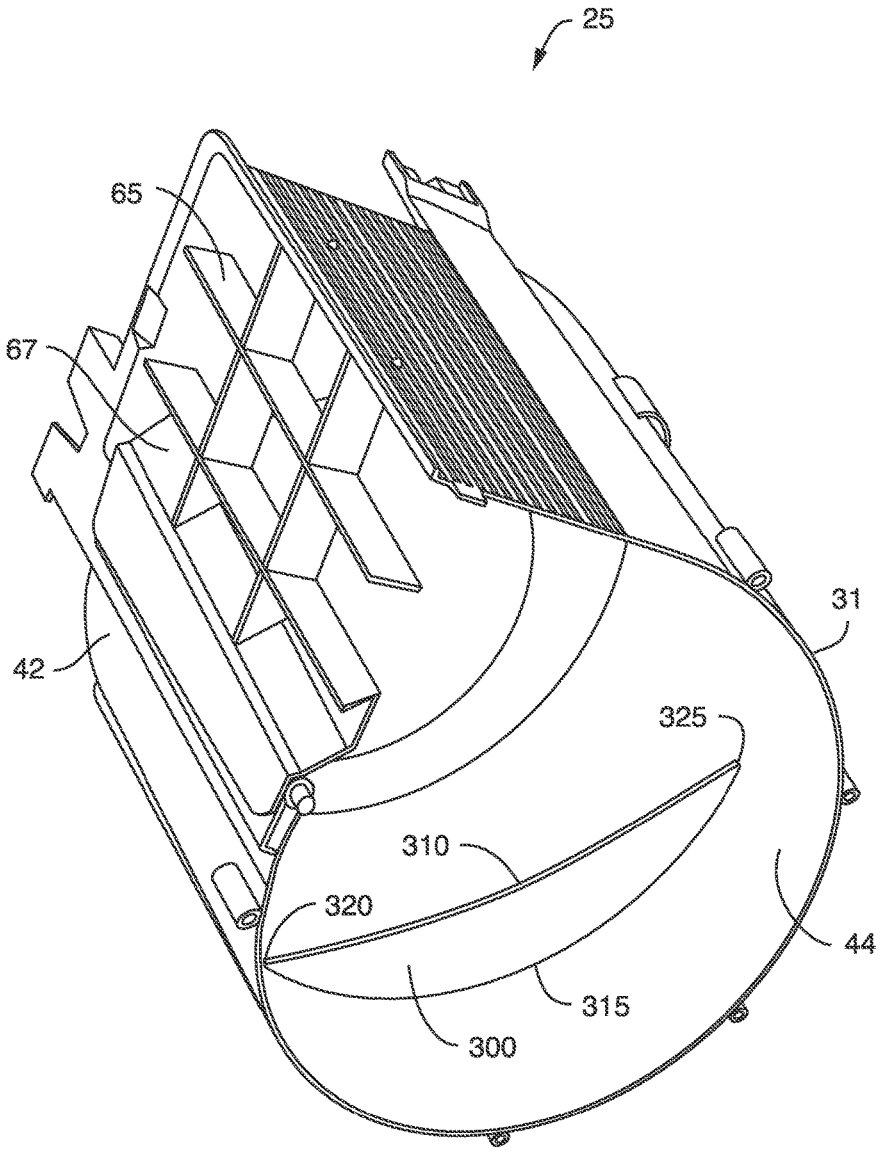
Figure 3C:
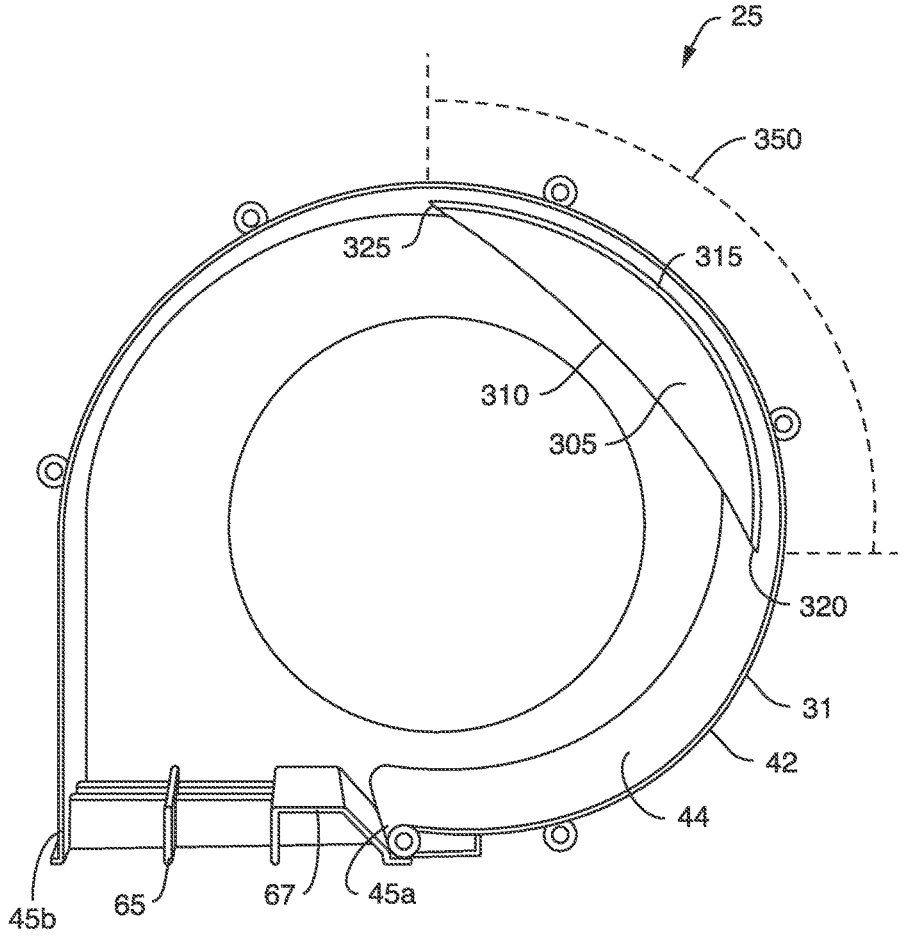
Figure 3D:
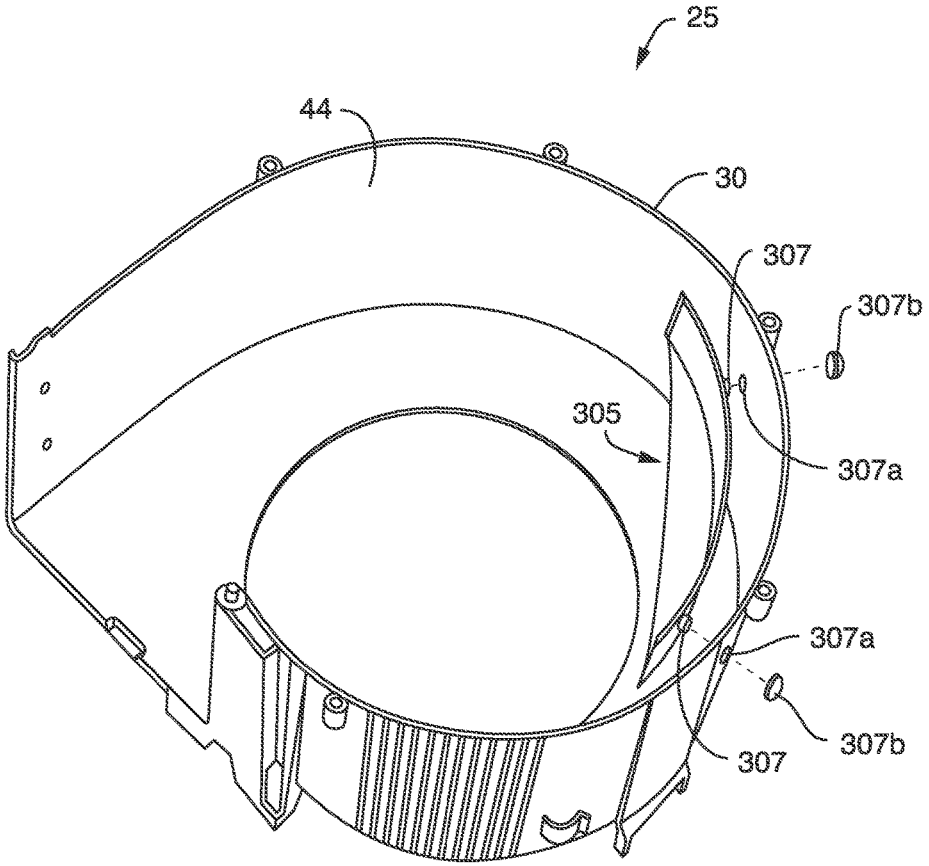
FIG. 3D shows an assembly view of a scroll assembly according to one embodiment of the invention.

As shown in FIGS. 3A-3C, some embodiments include a scroll crescent 300, 305 including a first crescent end 320 and a second crescent end 325. In some embodiments, the first crescent end 320 and the second crescent end 325, are coupled to the inner scroll surface 44 of the scroll housing 31. Some embodiments include a scroll crescent 300, 305 that includes a substantially incurvated surface 310, and a substantially convex surface 315 coupled to the inner surface 44 of the scroll housing 31. In some embodiments, the substantially convex surface 315 is coupled to the first crescent end 320, the second crescent end 325, and the substantially incurvated surface 310.

Some embodiments can include some other features designed to change, or otherwise guide the flow of fluid within the scroll 30. For example, in some embodiments, one or more structures can be included in the scroll 30 to change the flow of a fluid during exit from the scroll 30 through the discharge outlet 35. In some embodiments, these features can reduce the noise emitted by the ventilation assembly 10 as it leaves the scroll 30 either alone, or in combination with the other features within the scroll 30, such as the scroll crescent 300, 305.

Figure 4A:
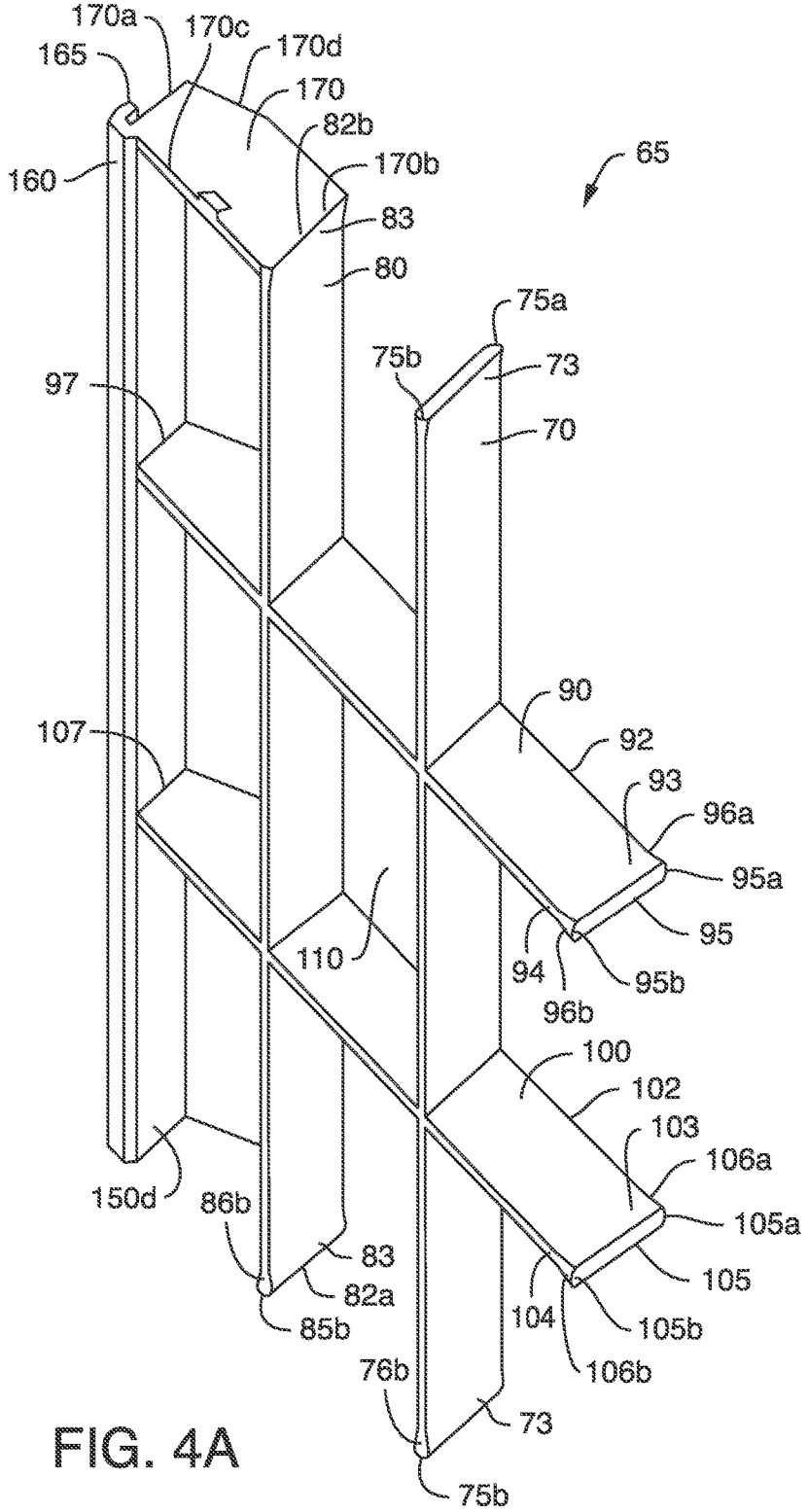
FIG. 4A is a perspective view of a discharge grid according to one embodiment of the invention.
Figure 4B:
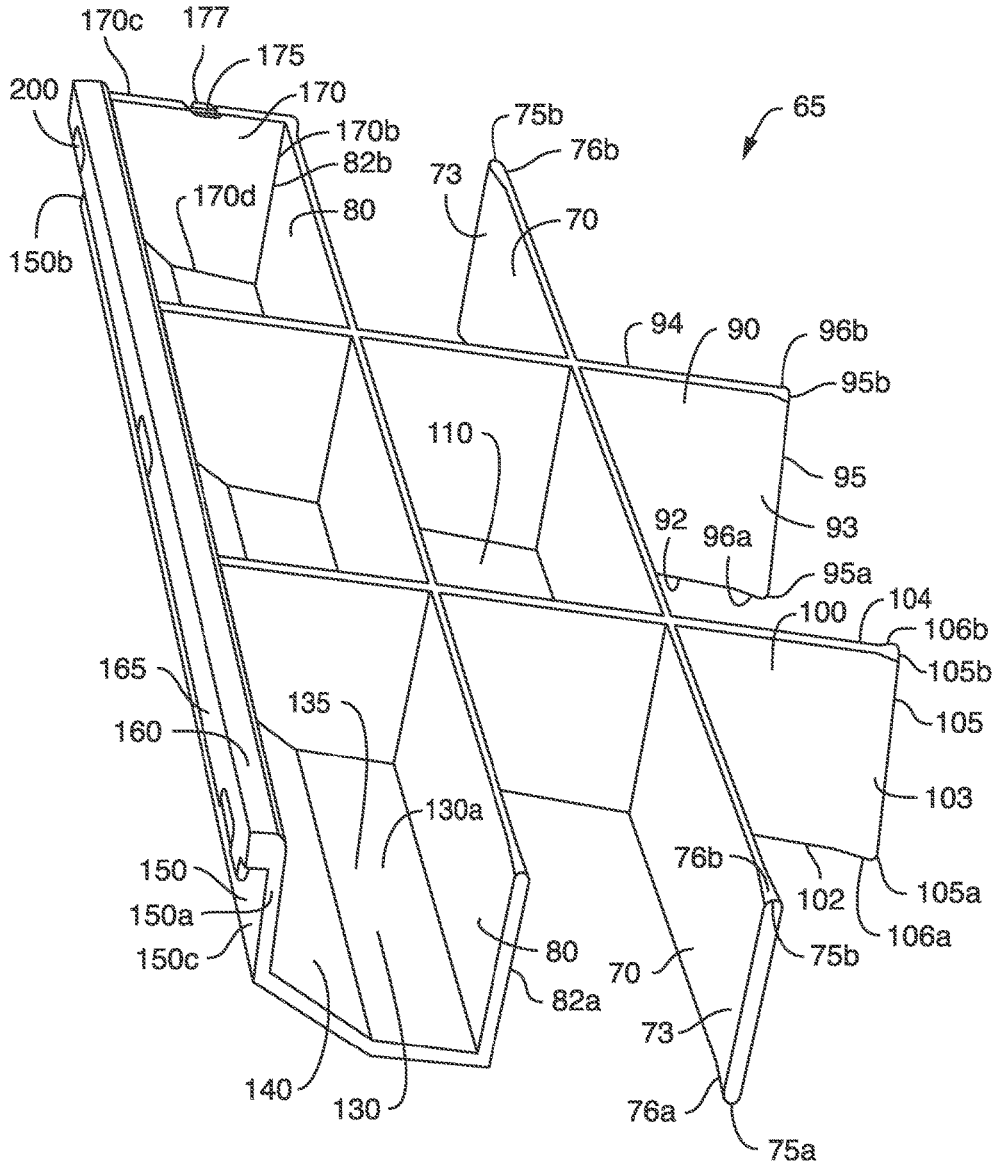
FIG. 4B is a perspective view of a discharge grid according to one embodiment of the invention.
Figure 4C:
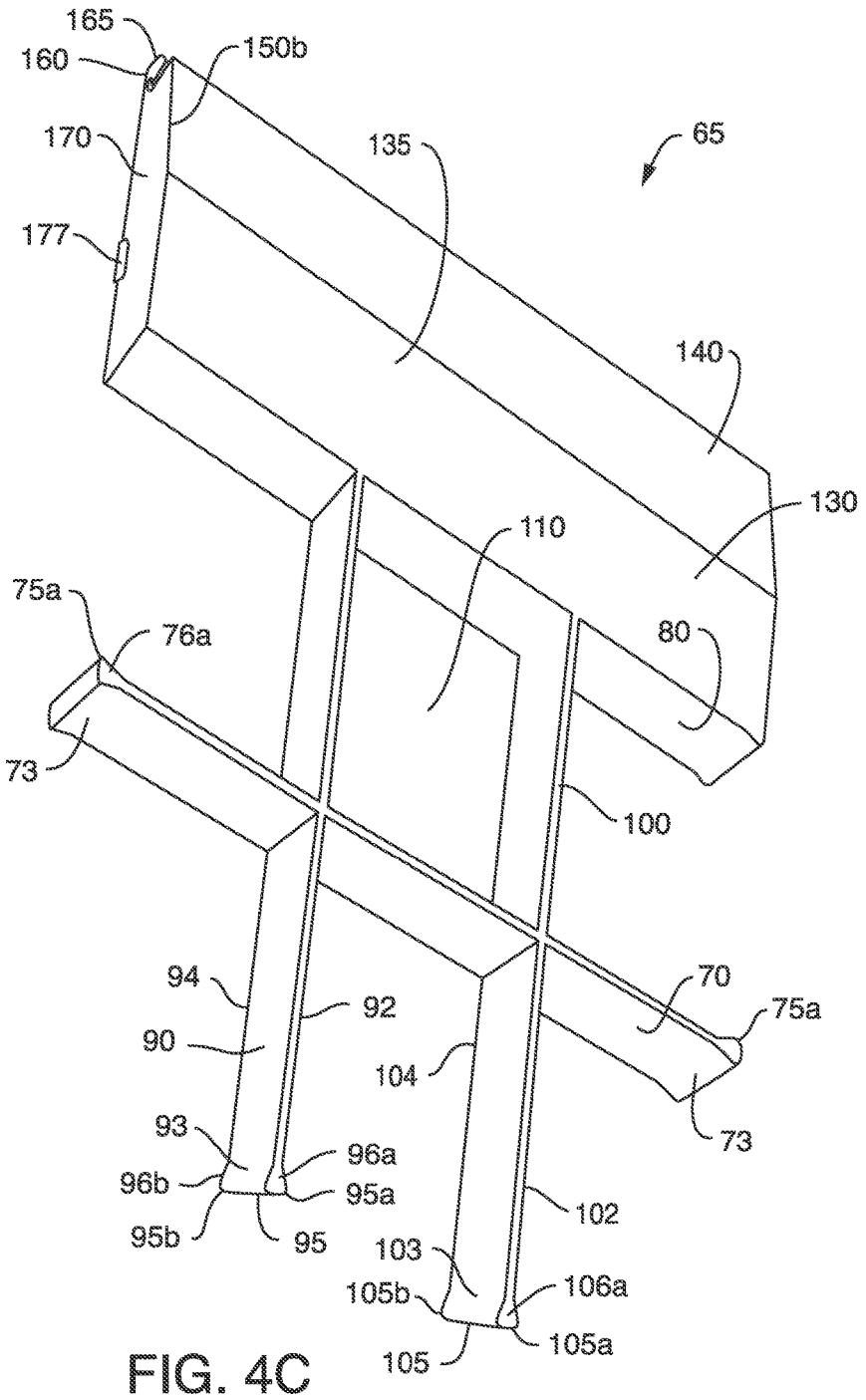
FIG. 4C is a perspective view of a discharge grid according to one embodiment of the invention.

In some embodiments, as fluid flows within the scroll 30 and approaches the outlet 35, one or more fins 70, 80, 90, 100 of the discharge grid 65 can at least partially straighten the air and just prior to discharge from the scroll 30 through the outlet 35. For example, as detailed in FIGS. 4A-4C showing various perspective views of a discharge grid 65 according to one embodiment of the invention, some embodiments can include a plurality of vertical fins 70, 80 and a plurality of horizontal fins 90, 100. In some embodiments, the coupling of the plurality of vertical fins 70,80 and a plurality of horizontal fins 90, 100 can create at least one aperture 110.

As described earlier, in some embodiments of the invention, a base wall 170 is coupled to the main wall 150 and the restriction wall 130. In some embodiments, the first end 170*a* of the base wall 170 is coupled with the second end 150*b* at the second surface 150*d* of the main wall 150, and the bottom base edge 170*d* is coupled with the restriction wall 130. Some embodiments include the first vertical fin 80 which includes a first end 82*a* and a second end 82*b*. In some further embodiments, the second end 170*b* of the base wall 170 is also coupled to the first vertical fin 80 second end 82*b*.

Some embodiments include a plurality of horizontal fins 90, 100. As shown in FIGS. 4A-4B, in some embodiments, the discharge grid 65 includes a plurality of horizontal fins 90, 100. Some embodiments include at least one the plurality of horizontal fins 90, 100 coupled to the second surface 150*d* of the main wall 150 and an inner surface 130*a* of the restriction wall and the first vertical fin 80. Some embodiments include a first horizontal fin 90 and a second horizontal fin 100. Some embodiments can include additional horizontal fins (not shown) substantially identical in structure to horizontal fins 90, 100. In some embodiments, any additional horizontal fins can be spaced substantially similarly to the horizontal fins 90, 100. In some other embodiments, any additional horizontal fins can be spaced substantially differently to the horizontal fins 90,100.

In some embodiments, the first horizontal fin 90 can include a first end 95, a second end 97, a top edge 94 and a bottom edge 92. In some embodiments, the second end 97 can be coupled to the second surface 150*d* of the main wall 150. In some further embodiments, the bottom edge 92 can be coupled to the inner surface 130*a* of the restriction wall 130. In some further embodiments, the first horizontal fin 90 can couple with the first vertical fin 80. In some further embodiments, the first horizontal fin 90 can couple with a second vertical fin 70. In other embodiments, the first horizontal fin 90 can couple with at least one other vertical fin (not shown). Some embodiments can include additional horizontal fins. For example, some embodiments include a second horizontal fin 100.

In some embodiments, the second horizontal fin 100 can include a first end 105, a second end 107, a top edge 104 and a bottom edge 102. In some embodiments, the second end 107 can be coupled to the second surface 150*d* of the main wall 150. In some further embodiments, the bottom edge 102 can be coupled to the inner surface 130*a* of the restriction wall 130. In some further embodiments, the second horizontal fin 100 can couple with the first vertical fin 80. In some further embodiments, the second horizontal fin 100 can couple with a second vertical fin 70. In other embodiments, the horizontal fin 100 can couple with at least one other vertical fin (not shown).

As described and shown in FIGS. 4A-4C, at least one of the plurality of horizontal fins 90,100 can couple with the main wall 150 and the outlet restriction 67 to couple with at least one other vertical fin (at least vertical fins 80 or 70), and by doing so, can form at least one aperture 110. Furthermore, as shown in FIGS. 1A-1D, 2A-2C, and 3B, in some embodiments, when the discharge grid is coupled with the scroll 30, further apertures 110 can be form as a result of coupling at least one of the plurality of vertical fins 70, 80 and at least one of the plurality of horizontal fins 90, 100 with one or more surfaces of the scroll 30. Moreover, as shown, in some embodiments, the coupling of the discharge grid 65 with the scroll housing 31 can for a plurality of apertures 110. In some embodiments, at least one of the plurality of apertures 110 can at least partially guide a flow of fluid emerging from the scroll 30 through the discharge outlet 35.

Some embodiments include further features designed to change, or otherwise guide the flow of fluid within the scroll 30. For example, in some embodiments, one or more structures can be included in the scroll 30 to change the flow of a fluid during exit from the scroll 30 through the discharge outlet 35. For example, as shown in FIGS. 4A-4C, in some embodiments one or more of the at least one of the plurality of vertical fins 70, 80 and at least one of the plurality of horizontal fins 90, 100 can include a flared surface. For example, as shown in FIG. 4B, some embodiments include a first horizontal fin 90 including a flared surface 93. In some embodiments, the flared surface 93 includes a flare bottom 96*a* with a flare bottom length 95*a* and a flare top 96*b* with a flared top length 95*b*. In some embodiments, the flared surface 93 includes a flare bottom 96*a* with a flare bottom length 95*a* that comprises a surface that is at least partially curved. For example, in some embodiments, the flare bottom 96*a* includes a flare bottom length 95*a* that comprises a substantially rounded surface. In some other embodiments, the flared surface 93 includes a flare top 96*b* with a flare top length 95*b* that comprises a surface that is at least partially curved. For example, in some embodiments, the flare top 96*b* includes a flare top length 95*b* that comprises a substantially rounded surface. In some embodiments, one or more of the curved surfaces of flare top 96*b* or flare bottom 96*a* can at least partially direct, or otherwise modify a flow of fluid emerging from the scroll 30 through the discharge outlet 35.

Figure 5:
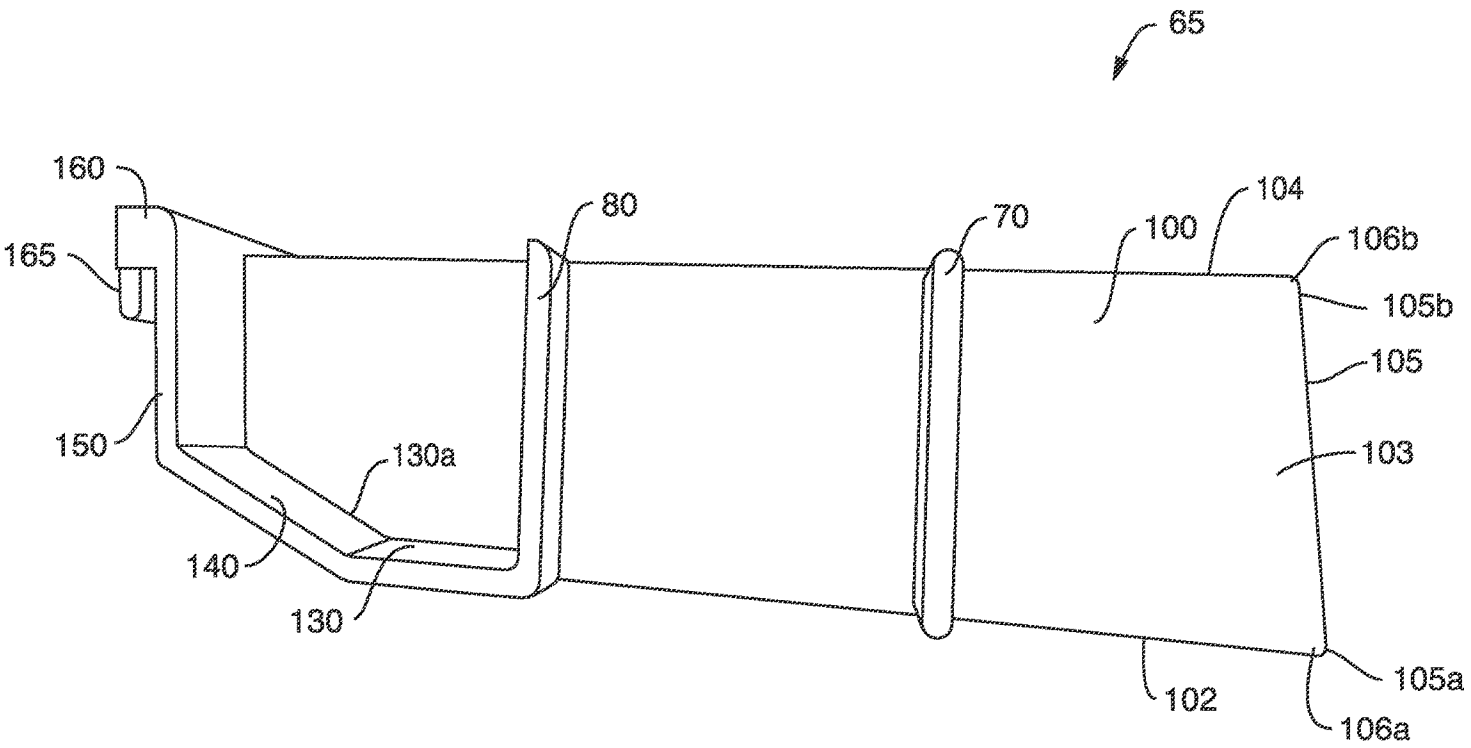
FIG. 5 is side perspective view of a discharge grid according to one embodiment of the invention.

Some embodiments include further features designed to change, or otherwise guide the flow of fluid within the scroll 30. For example, as shown in FIG. 4B and FIG. 5, some embodiments include a second horizontal fin 100 including a flared surface 103. In some embodiments, the flared surface 103 includes a flare bottom 106*a* with a flare bottom length 105*a* and a flare top 106*b* with a flared top length 105*b*. In some embodiments, the flared surface 103 includes a flare bottom 106*a* with a flare bottom length 105*a* that comprises a surface that is at least partially curved. For example, in some embodiments, the flare bottom 106*a* includes a flare bottom length 105*a* that comprises a substantially rounded surface. In some other embodiments, the flared surface 103 includes a flare top 106*b* with a flare top length 105*b* that comprises a surface that is at least partially curved. For example, in some embodiments, the flare top 106*b* includes a flare top length 105*b* that comprises a substantially rounded surface. In some embodiments, one or more of the curved surfaces of flare top 106*b* or flare bottom 106*a* can at least partially direct, or otherwise modify a flow of fluid emerging from the scroll 30 through the discharge outlet 35.

Some embodiments include further features designed to change, or otherwise guide the flow of fluid within the scroll 30. For example, in some embodiments, one or more structures can be included in the scroll 30 to change the flow of a fluid during exit from the scroll 30 through the discharge outlet 35. For example, as shown in FIGS. 4A-4C, in some embodiments one or more of the at least one of the plurality of vertical fins 70, 80 can include a flared surface. For example, as shown, some embodiments include a first vertical fin 80 including a flared surface 83. In some embodiments, the flared surface 83 includes a flare bottom 86*a* with a flare bottom length 85*a* and a flare top 86*b* with a flared top length 85*b*. In some embodiments, the flared surface 83 includes a flare bottom 86*a* with a flare bottom length 85*a* that comprises a surface that is at least partially curved. For example, in some embodiments, the flare bottom 86*a* includes a flare bottom length 85*a* that comprises a substantially rounded surface. In some other embodiments, the flared surface 83 includes a flare top 86*b* with a flare top length 85*b* that comprises a surface that is at least partially curved. For example, in some embodiments, the flare top 86*b* includes a flare top length 85*b* that comprises a substantially rounded surface. In some embodiments, one or more of the curved surfaces of flare top 86*b* or flare bottom 86*a* can at least partially direct, or otherwise modify a flow of fluid emerging from the scroll 30 through the discharge outlet 35.

Some embodiments include further features designed to change, or otherwise guide the flow of fluid within the scroll 30. For example, in some embodiments, one or more structures can be included in the scroll 30 to change the flow of a fluid during exit from the scroll 30 through the discharge outlet 35. For example, as shown in FIGS. 4A-4C, in some embodiments one or more of the at least one of the plurality of vertical fins 70, 80 can include a flared surface. For example, as shown, some embodiments include a second vertical fin 70 including a flared surface 73. In some embodiments, the flared surface 73 includes a flare bottom 76*a* with a flare bottom length 75*a* and a flare top 76*b* with a flared top length 75*b*. In some embodiments, the flared surface 73 includes a flare bottom 76*a* with a flare bottom length 75*a* that comprises a surface that is at least partially curved. For example, in some embodiments, the flare bottom 76*a* includes a flare bottom length 75*a* that comprises a substantially rounded surface. In some other embodiments, the flared surface 73 includes a flare top 76*b* with a flare top length 75*b* that comprises a surface that is at least partially curved. For example, in some embodiments, the flare top 76*b* includes a flare top length 75*b* that comprises a substantially rounded surface. In some embodiments, one or more of the curved surfaces of flare top 76*b* or flare bottom 76*a* can at least partially direct, or otherwise modify a flow of fluid emerging from the scroll 30 through the discharge outlet 35.

In some embodiments as shown in FIGS. 4A-4C, the lengths of the flare bottom lengths 75*a*, 85*a* and flare top lengths 75*b*, 85*b* of the vertical fins 70, 80 are substantially equal. In other embodiments, one or more of the flare bottom lengths 75*a*, 85*a* and flare top lengths 75*b*, 85*b* can be substantially unequal (not shown). In some embodiments, as shown in FIGS. 4A-4C, the flare bottom lengths 95*a*, 105*a* and flare top lengths 95*b*, 105*b* of the horizontal fins 90, 100 are substantially unequal. As shown, the flare bottom lengths 95*a*, 105*a* are longer than the flare top lengths 95*b*, 105*b*. In some other embodiments, the flare bottom lengths 95*a*, 105*a* may be substantially equal in length to the flare top lengths 95*b*, 105*b* (not shown), whereas in other embodiments, the flare bottom lengths 95*a*, 105*a* may be less than the flare top lengths 95*b*, 105*b* (not shown).

Figure 6A:
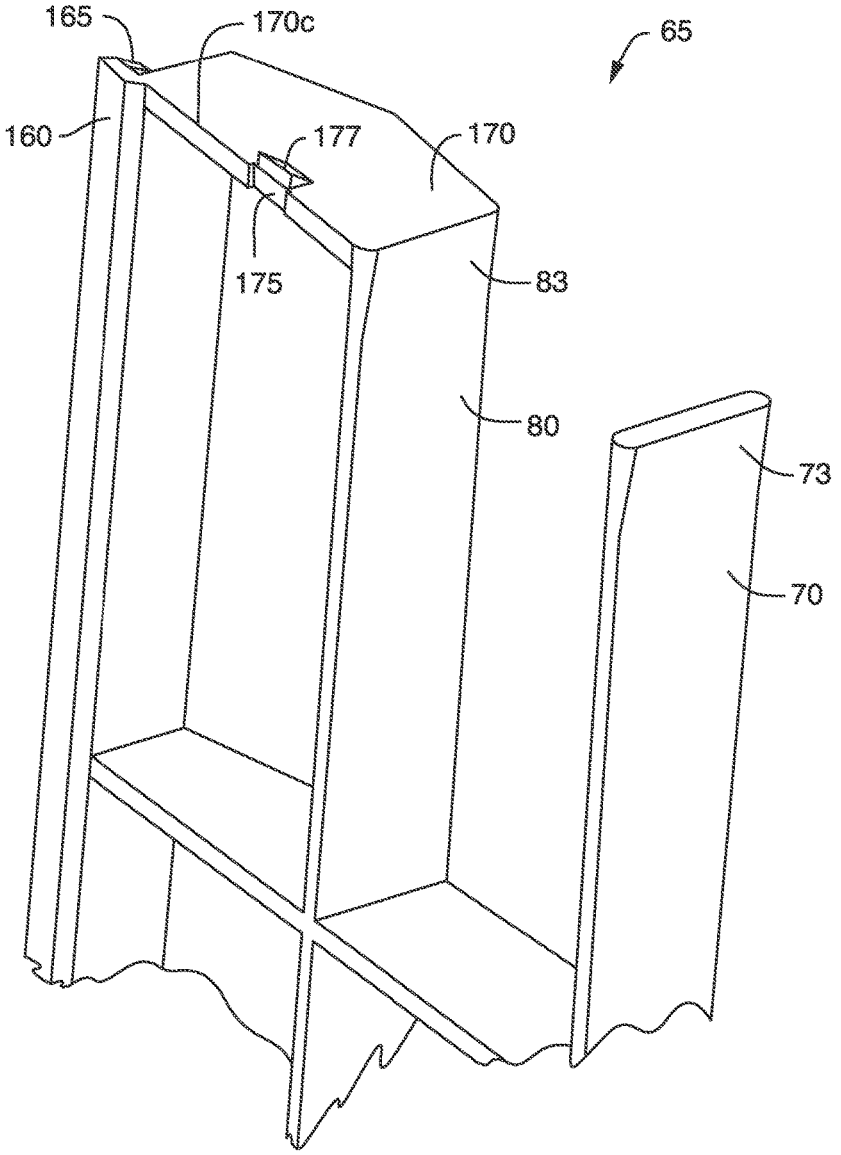
FIG. 6A is a partial perspective view of a discharge grid with snap-feature according to one embodiment of the invention
Figure 6B:
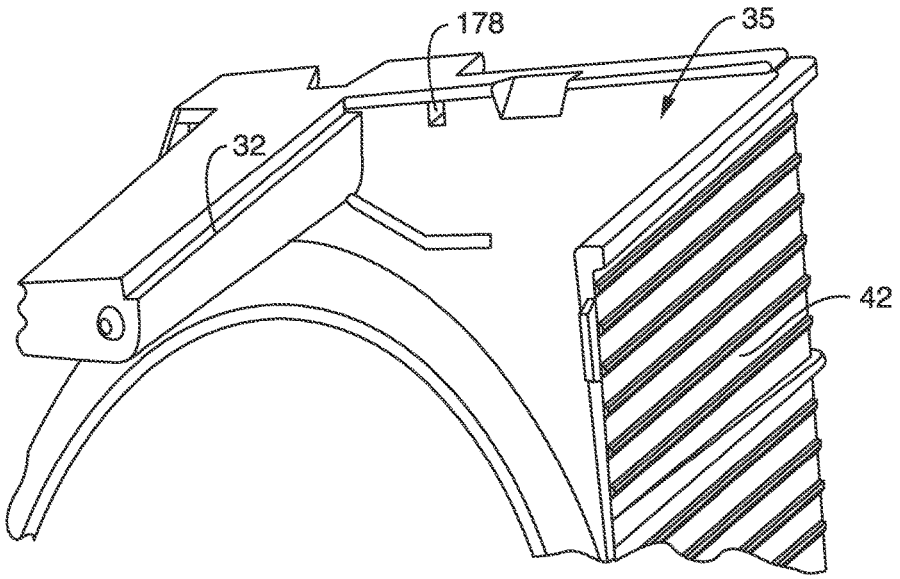
FIG. 6B is a partial perspective view of a scroll showing a snap-feature receptacle according to one embodiment of the invention.
Figure 7B:
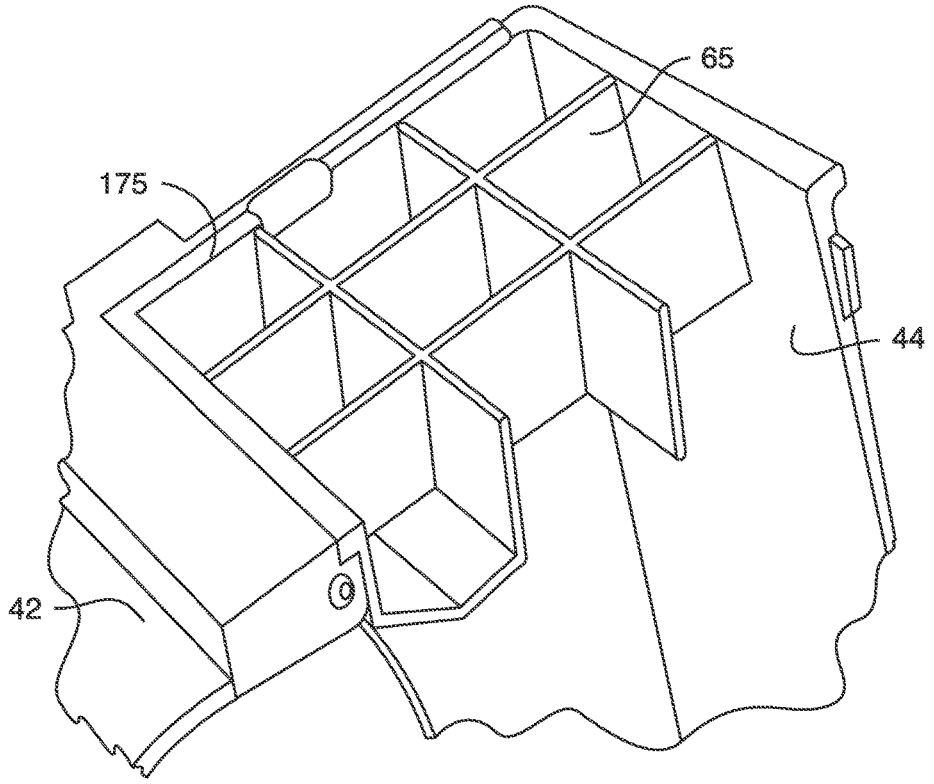
FIG. 7B is a partial perspective view of a discharge grid assembled into a scroll according to one embodiment of the invention.

As described earlier, in some embodiments, the discharge grid 65 can be formed as a discrete component and assembled with the scroll 30 by coupling to the scroll housing 31. Some embodiments include one or more features to enable coupling of the discharge grid 65 with the housing 31. For example, FIG. 6A is a partial perspective view of a discharge grid 65 with a base snap tab 177 according to one embodiment of the invention. As shown, the base snap tab 177 is coupled to the base wall 170 adjacent a slot 175 in the top base edge 170*c*. Some embodiments can include additional base snap tab 177 and slots 175 as required (not shown). In some embodiments, the discharge grid 65 can be coupled to the scroll 30 by coupling the base snap tab 177 with the scroll housing 31. For example, FIG. 6B is a partial perspective view of a scroll showing a snap-feature receptacle (snap slot 178) according to one embodiment of the invention. In some embodiments, the discharge grid 65 is secured to the scroll 30 by coupling the base snap tab 177 with the snap slot 178 (see for example FIGS. 7A and 7B showing partial perspective views of a discharge grid 65 assembled into a scroll 30 and scroll housing 31 according to one embodiment of the invention). In some other embodiments, other fasteners can be used in addition to, or in place of the base snap tab 177 and snap slot 178 coupling.

Figure 8A:
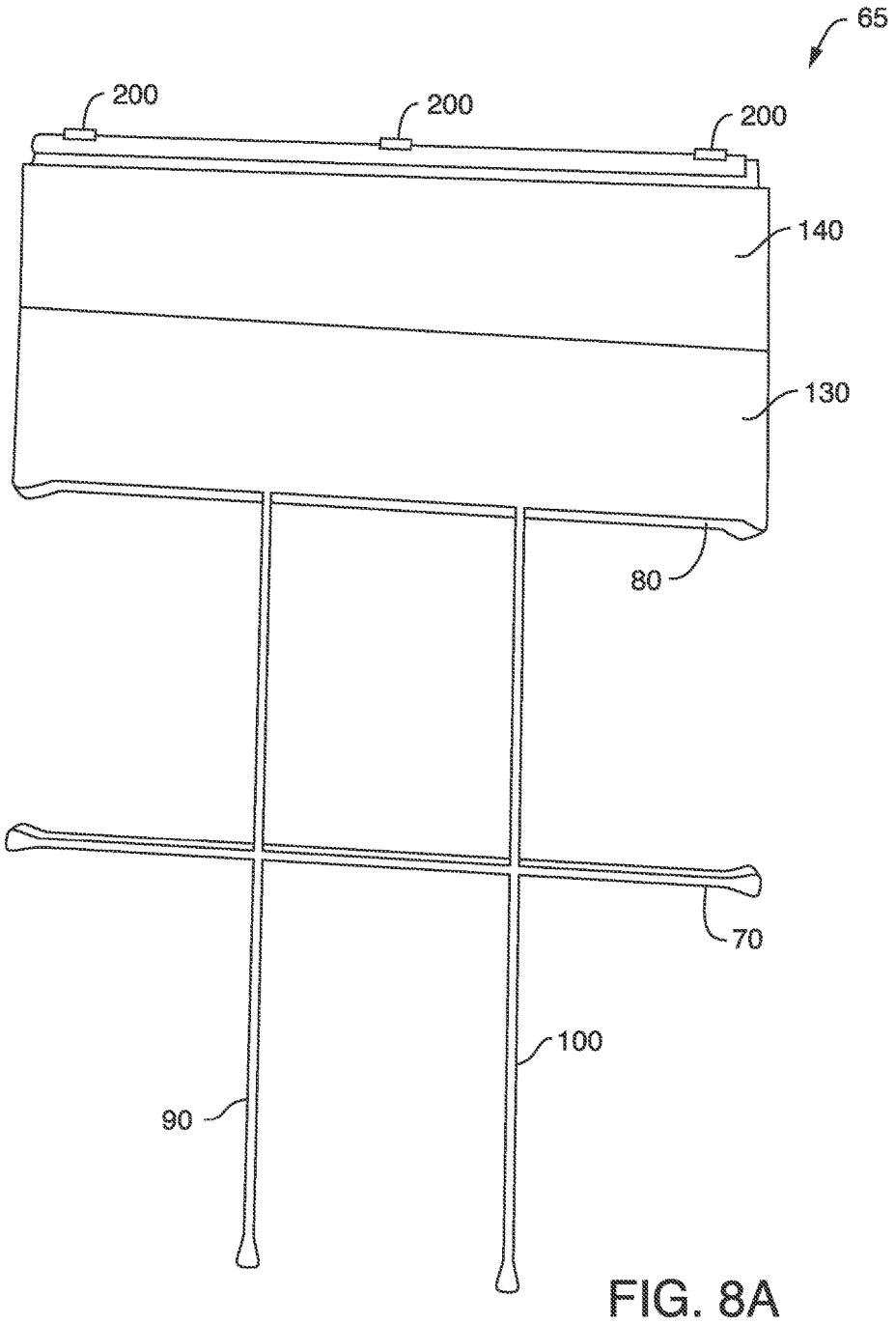
FIG. 8A is a top perspective view of a discharge grid according to one embodiment of the invention.
Figure 8B:
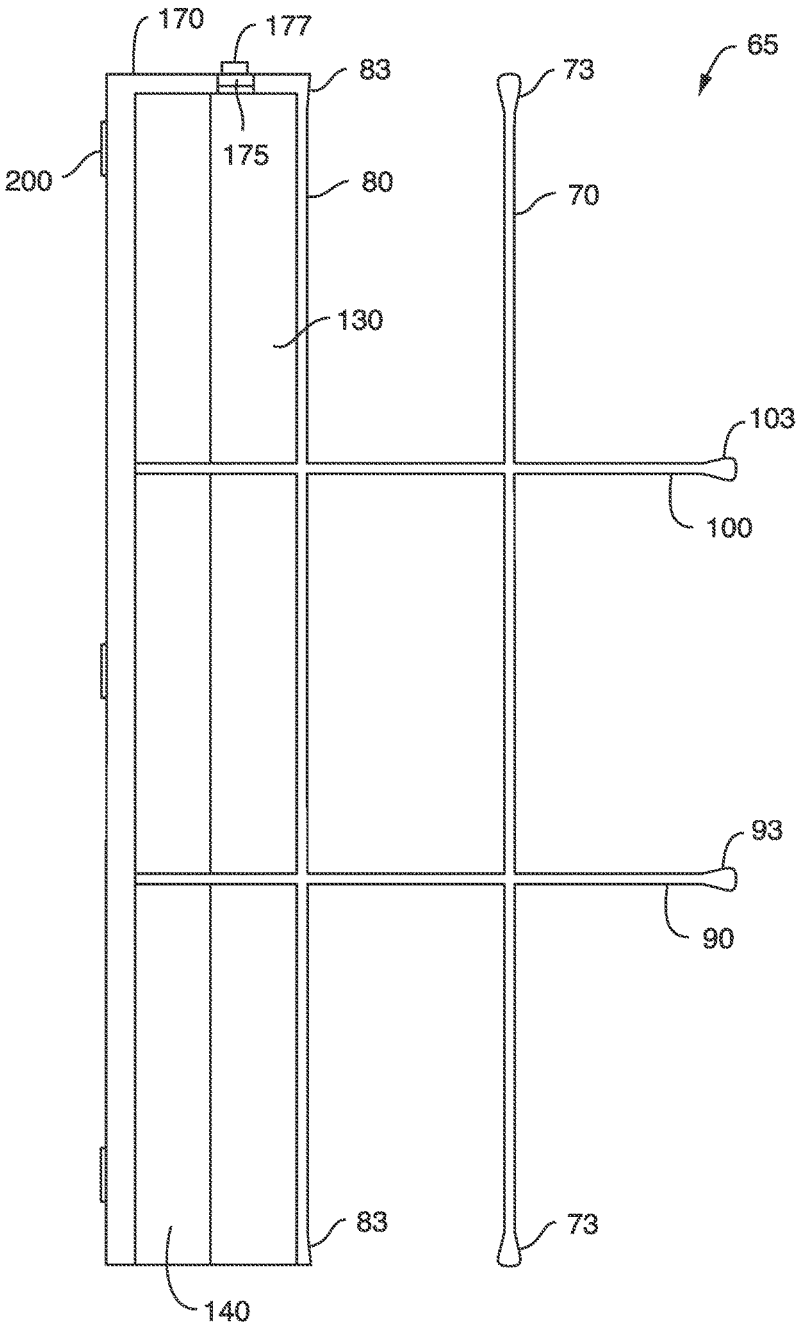
FIG. 8B is a bottom perspective view of a discharge grid according to one embodiment of the invention.
Figure 9A:
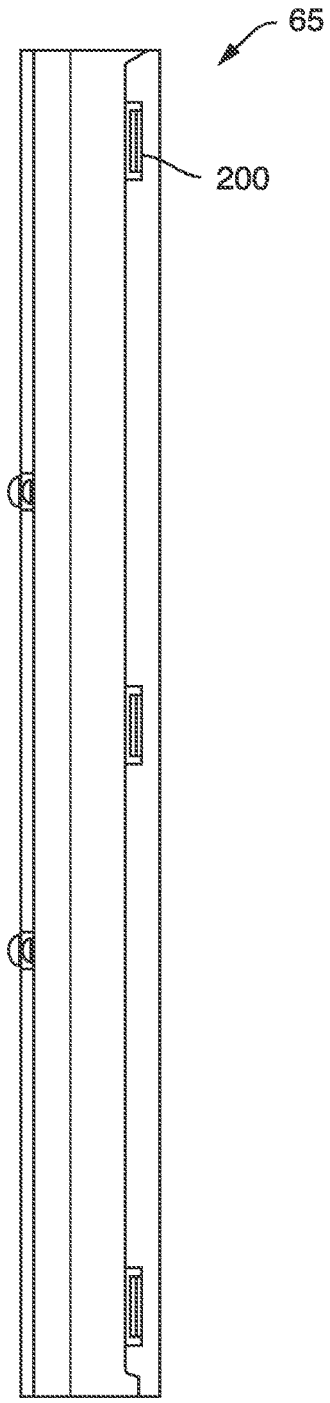
FIG. 9A is a front perspective view of a discharge grid according to one embodiment of the invention.
Figure 9B:
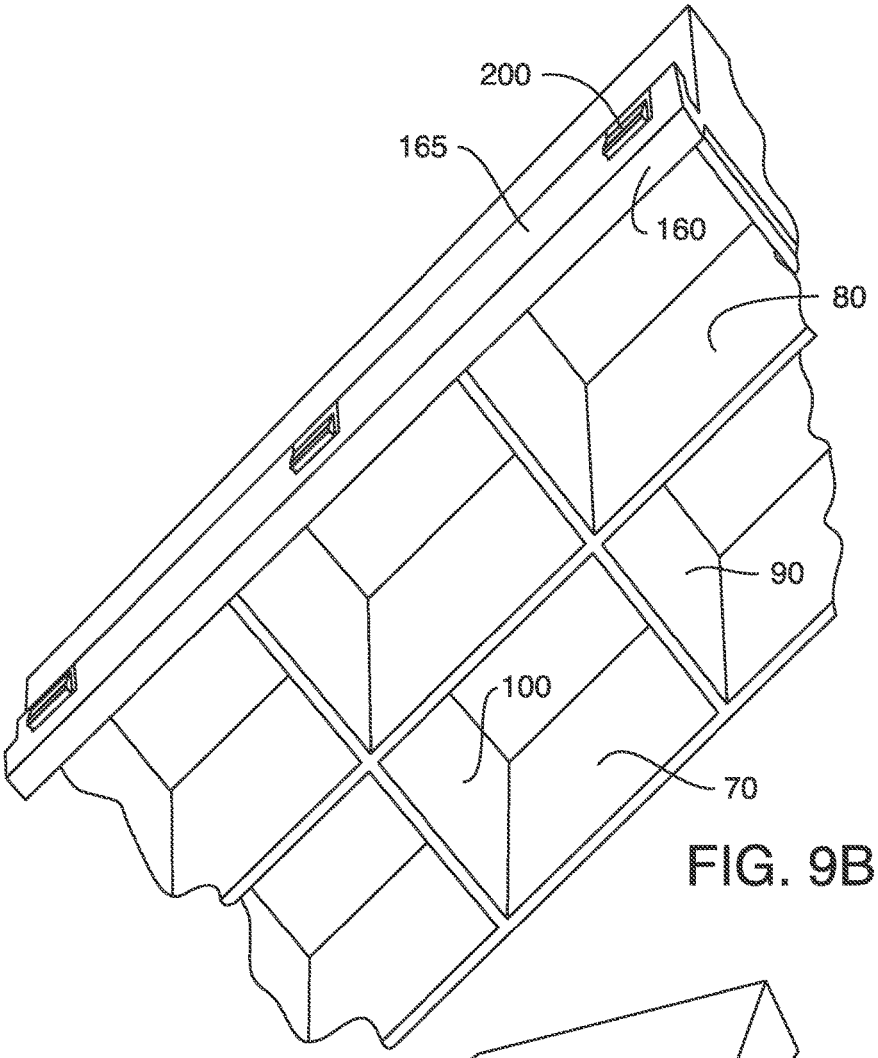
FIG. 9B is a perspective view of a discharge grid showing snap-features according to one embodiment of the invention.
Figure 9C:
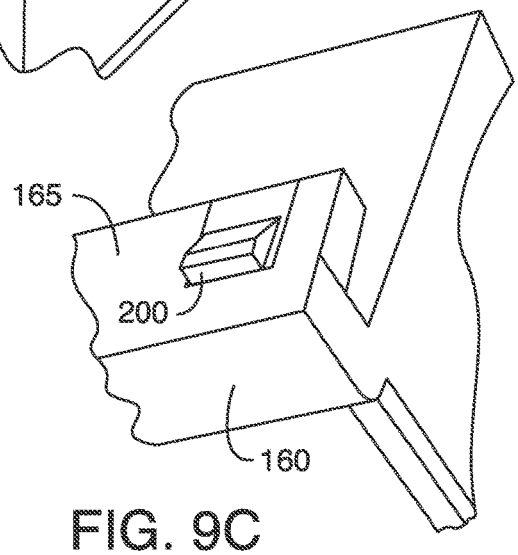
FIG. 9C is a partial perspective view of a discharge grid snap-feature according to one embodiment of the invention.
Figure 9D:
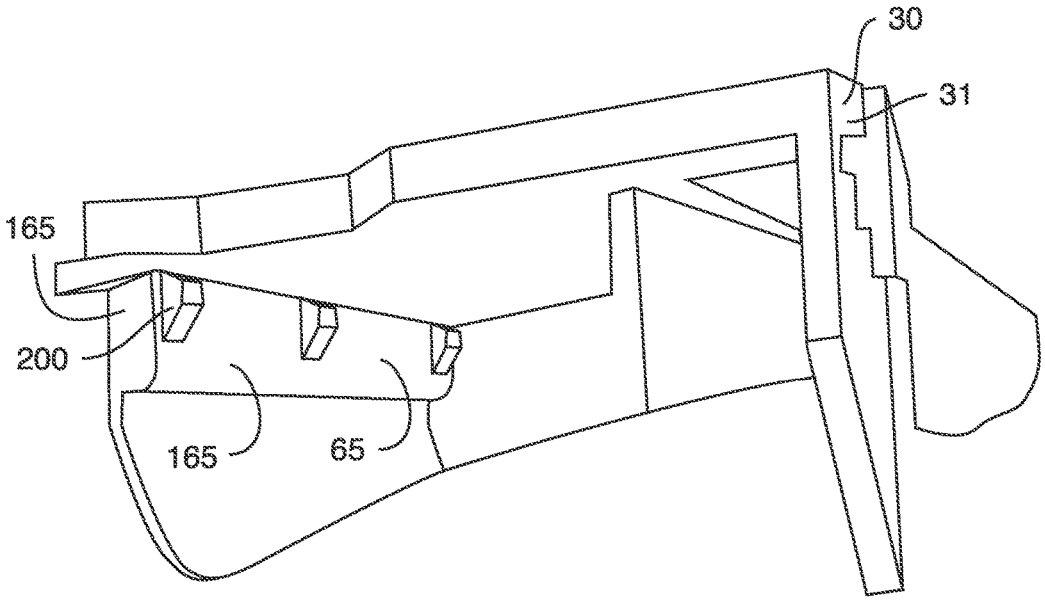
FIG. 9D is a partial perspective view of a scroll assembly with a discharge grid snap feature attachment region according to one embodiment of the invention.
Figure 9E:
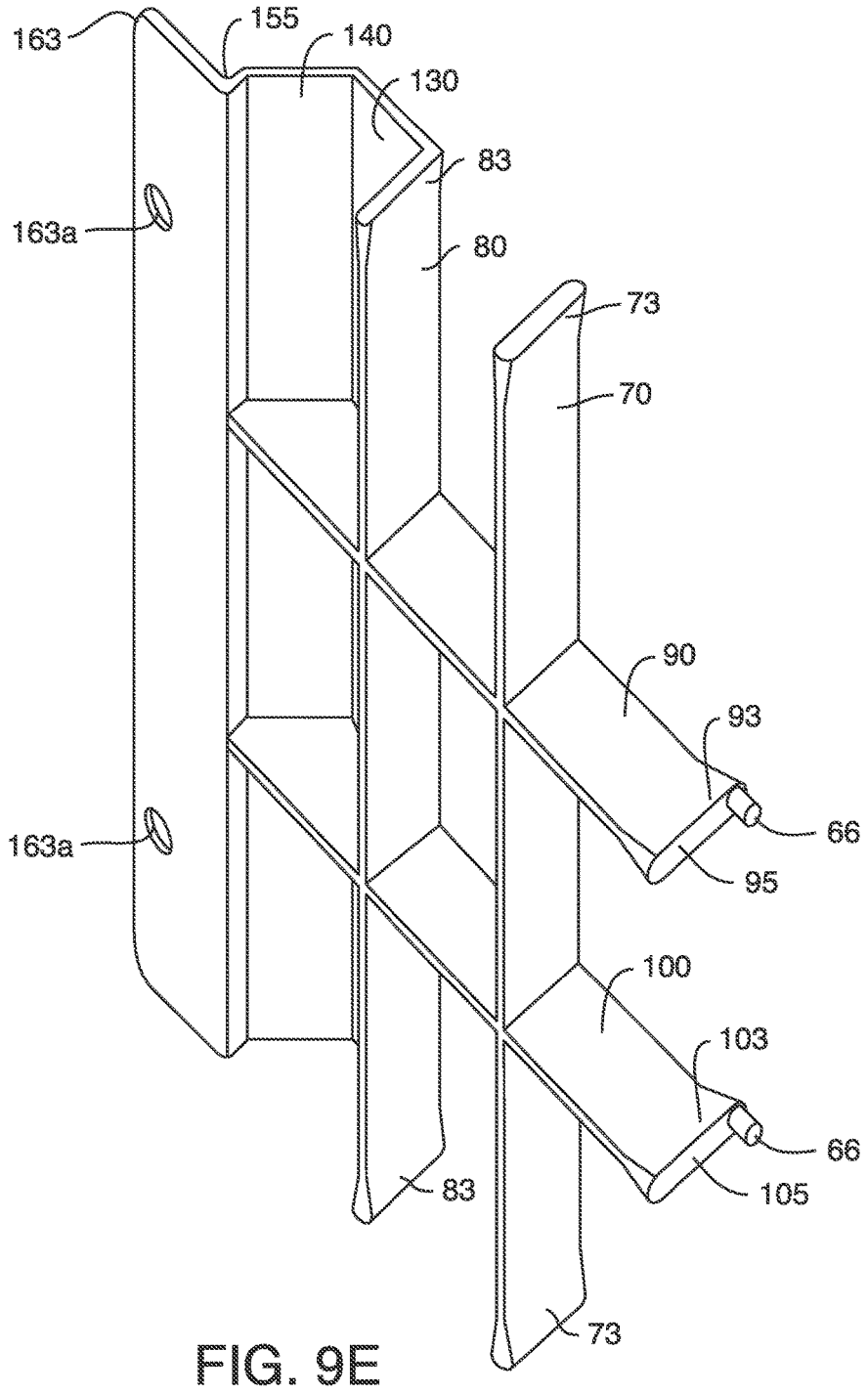
FIGS. 9E-9H illustrates various perspective views of a discharge grid according to another embodiment of the invention.
Figure 9F:
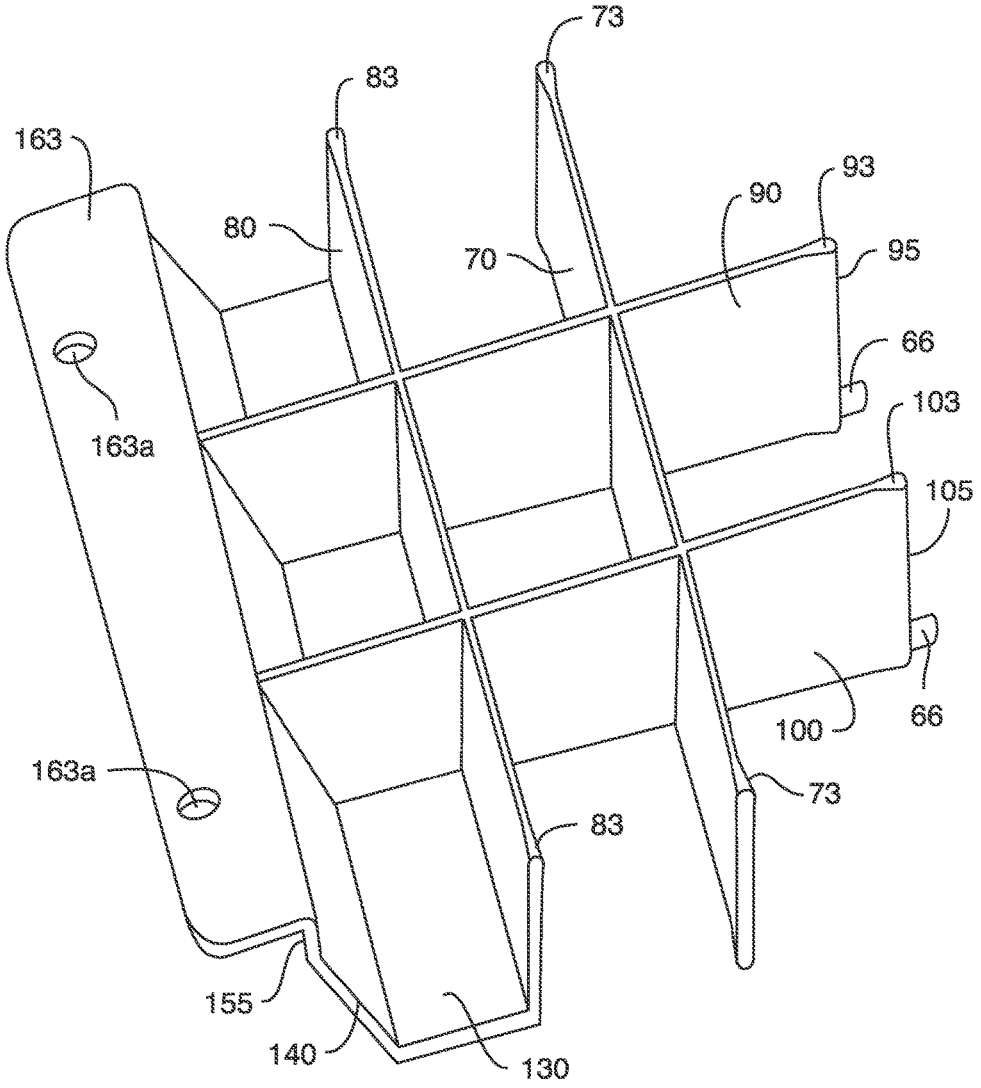
Figure 9G:
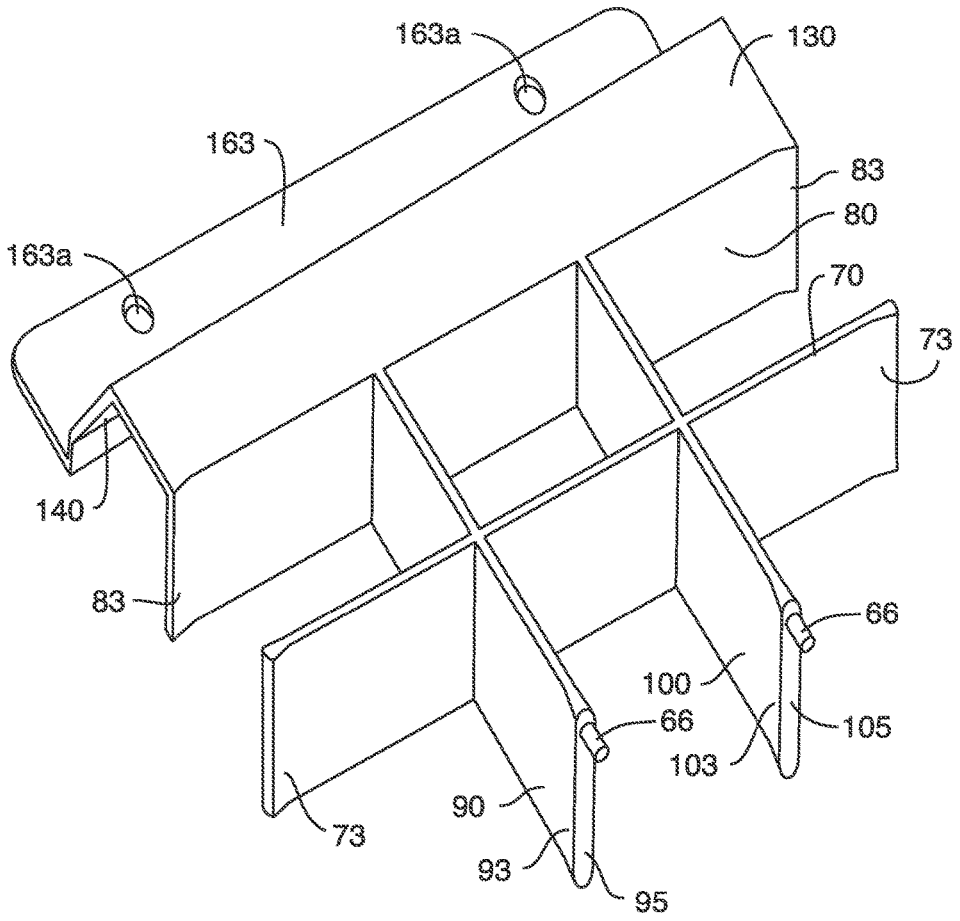
Figure 9H:
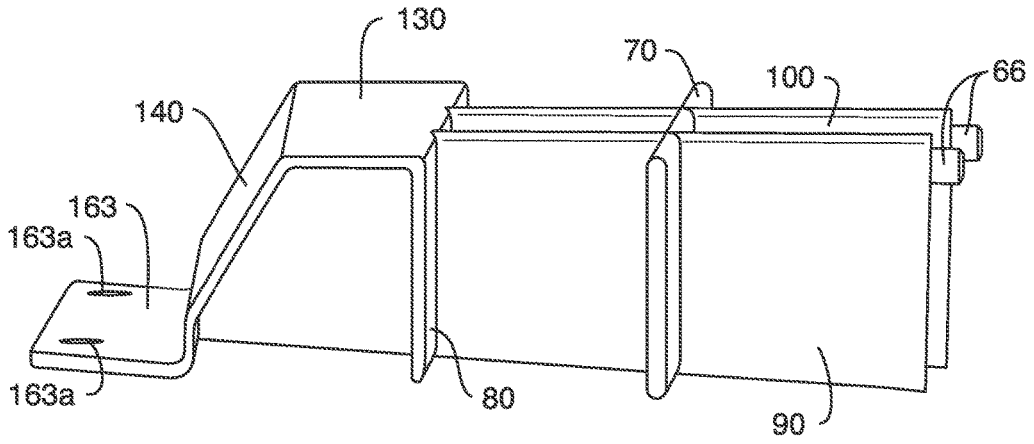

Some embodiments include additional features for coupling the discharge grid 65 with the scroll 30. For example, referring to FIGS. 8A and 8B showing top and bottom perspective views of a discharge grid 65 according to one embodiment of the invention, as well as FIG. 9A-9D showing various full and partial perspective views of a discharge grid 65 according to one embodiment of the invention, in some embodiments, the discharge grid can include additional edge snaps 200. As shown, in some embodiments, the main wall 150 can include a flange 160. In some embodiments, the discharge grid 65 can further include a coupling edge 165 coupled to the flange 160. In some embodiments, the flange 160 and coupling edge 165 can be coupled to a vertical slot 32 in the scroll housing 31 (see 32 in FIG. 6B). For example, as show in FIGS. 8A-8B and 9A-9B, in some embodiments, the coupling edge 165 can include a plurality of edge snaps 200, and as depicted in FIG. 9D, the discharge grid 65 can be at least partially coupled to the scroll housing 31.

FIGS. 9E-9H illustrates various perspective views of another embodiment of a discharge grid 65 according to another embodiment of the invention. As shown, in some embodiments the discharge grid 65 can include an alternative main wall 155 without a coupled base wall 170. Moreover, in some embodiments, the main wall 155 can be coupled to an alternative flange 163. In some embodiments, the flange 163 can include at least one coupling hole 163*a*. As shown in FIG. 1D and the assembly view of FIG. 1E, in some embodiments, the discharge grid 65 can be coupled to the scroll 30 using fasteners 63 coupled through the flange 163 and coupling holes 163*a*, and through fastener holes 66*b* within the scroll 30. The example shown in FIGS. 1D and 1E provide just one embodiment of a grid 65 coupled to the scroll 30 using two fasteners 63. In some other embodiments, more or less fasteners 63 may be used with more or less fastener holes 66*b* and coupling holes 163*a*. In some embodiments, the coupling holes 163*a* may be placed in other locations on the flange 160 and may be coupled with fastener holes 66*b* positioned corresponding to the fastener holes 66*b*.

Figure 10B:
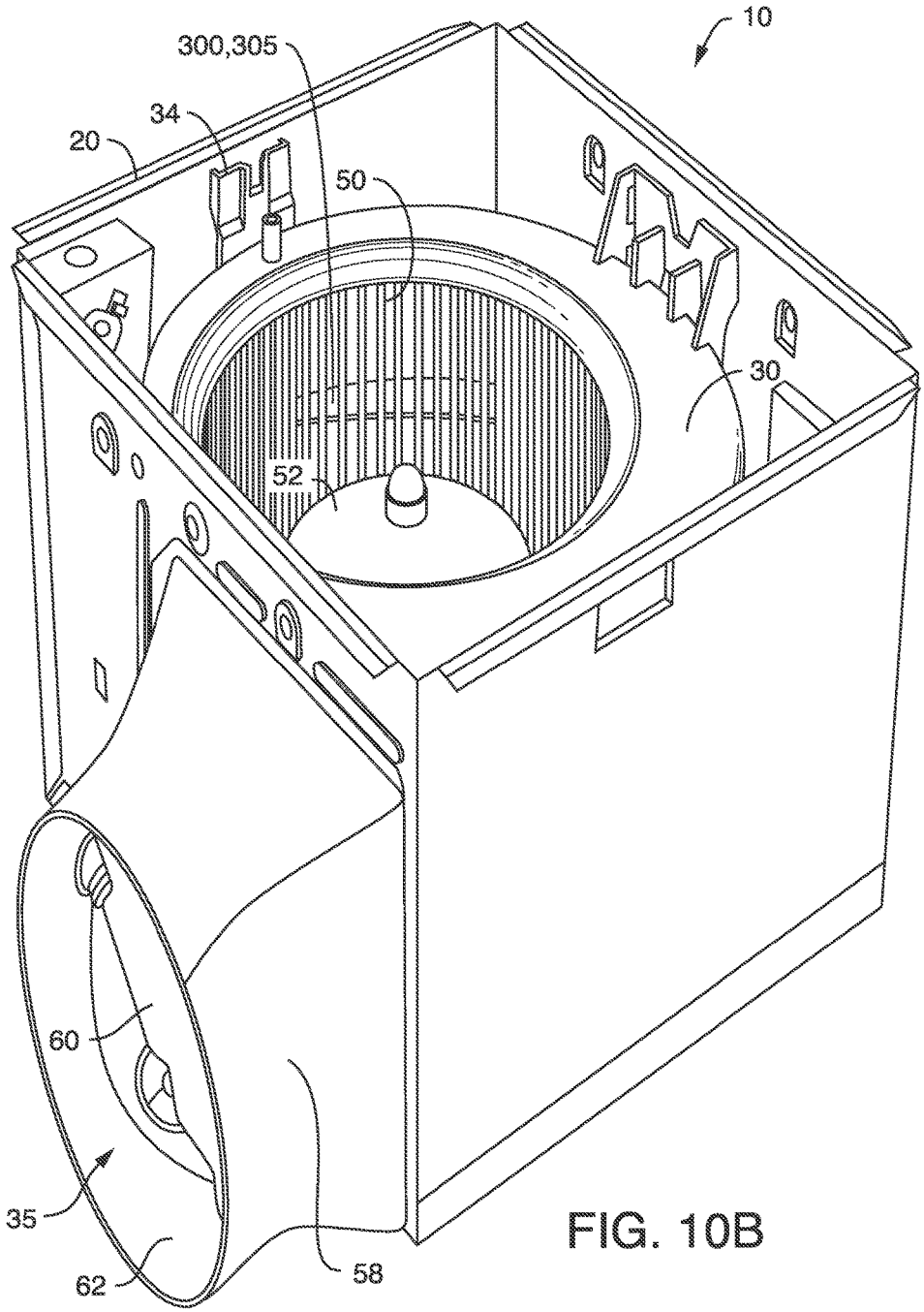
FIG. 10B illustrates a perspective view of a ventilation assembly according to one embodiment of the invention.
Figure 10C:
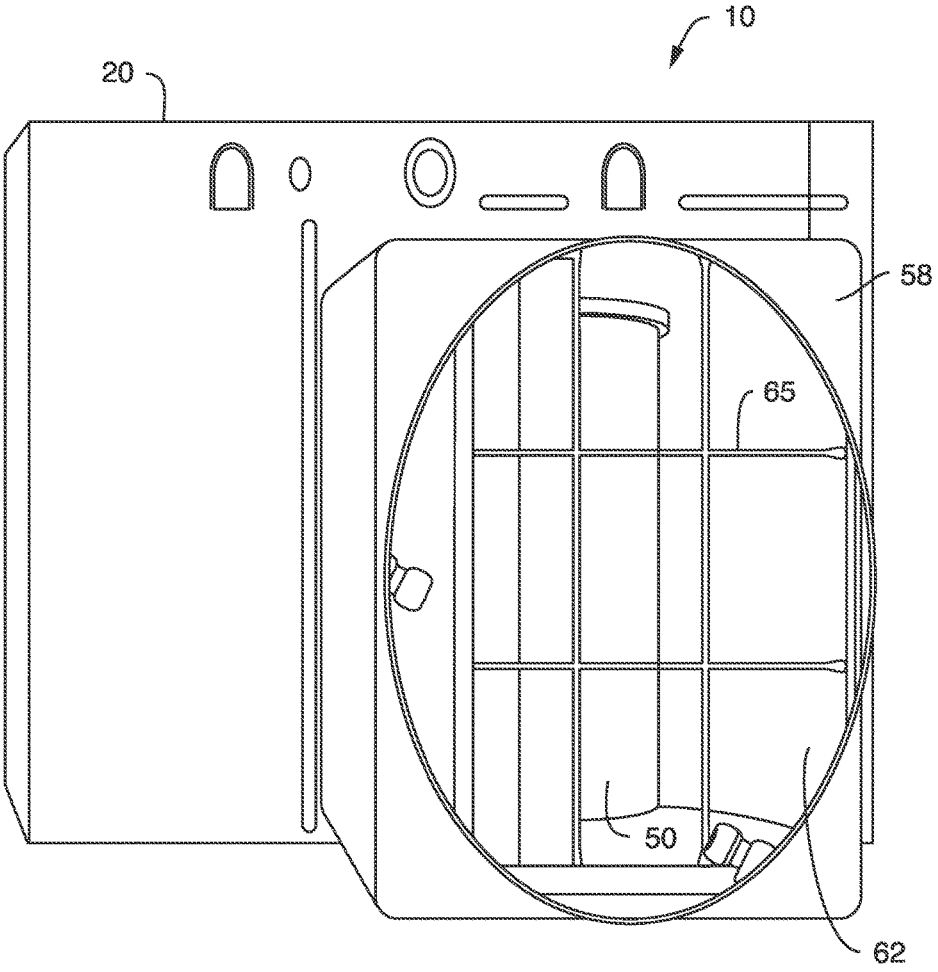
FIG. 10C illustrates a front perspective view of the ventilation assembly according to one embodiment of the invention.

FIG. 10A illustrates a perspective view of a blower assembly 15 according to one embodiment of the invention, and FIG. 10B illustrates a perspective view of a ventilation assembly 10 according to one embodiment of the invention. As described earlier, some embodiments of the ventilation assembly 10 can include various components and devices that can perform different functions. For example, in some embodiments the ventilation assembly 10 can include the blower assembly 15 as shown in FIG. 10A. In some embodiments, the blower assembly 15 can be substantially housed within the housing 20, and positioned and anchored to the housing 20 aided by at least one retention feature 34. In some embodiments, the blower assembly 15 can generally include a motor 52 and a blower wheel 50 positioned substantially within the scroll 30 and mechanically coupled to the motor 52. In some embodiments, a duct connector assembly 58 can be coupled to the ventilation assembly 10. For example, as shown in FIGS. 10B and 10C, in some embodiments, the duct connector assembly 58 is coupled to the housing 20 so as to be generally aligned with the discharge outlet 35 of the scroll 30. FIG. 10C for example illustrates a front perspective view of the ventilation assembly 10 according to one embodiment of the invention where the damper flap 60 has been removed from view. As shown, the discharge grid 65 is positioned within the scroll 30 so as to be capable of directing and/or otherwise influencing a flow of fluid forced from the blower wheel 50 within the scroll 30 through the ventilation orifice 62.

As shown in FIG. 10B, some embodiments can include a duct connector assembly 58 that includes a moveable damper flap 60 coupled with a ventilation orifice 62. In some embodiments, the damper flap 60 can control the backflow of a fluid into a ventilation orifice 62 and the blower assembly 15. In some embodiments, a ventilation assembly 10 that includes a duct connector assembly 58 with a moveable damper flap 60 as shown can be capable of substantially controlling the flow of fluid from a space, such as a room, into the ventilation duct of a building, or structure or space.

In some embodiments, the ventilation assembly 10 can be operable to discharge fluid from a space to another location. For example, in some embodiments, when power is provided to the blower assembly 15, a motor 52 can rotate a blower wheel 50 positioned substantially within the scroll 30. In some embodiments of the invention as described and illustrated, fluid flow is moved substantially towards the duct connector assembly 58. In some embodiments, the moveable damper flap 60 coupled with a ventilation orifice 62 will open, allowing fluid to be expelled from the ventilation assembly 10. In some embodiments, the damper flap 60 can control the backflow of a fluid into the ventilation orifice 62 and the blower assembly 15.

In some embodiments, the ventilation orifice 62 can be capable of substantially controlling the flow of fluid from a space, such as a room, into the ventilation duct of a building, or structure, to an outside location. Furthermore, the duct connector assembly 58 is further capable of substantially controlling the flow of fluid from a space into the ventilation of a duct of a building when the motor 52 is unpowered. For example in some embodiments, the moveable damper flap 60 can at least partially seal, or provide a substantially sealed ventilation orifice 62. In some embodiments, when the motor 52 is unpowered, the damper flap 60 can at least partially prevent, or substantially prevent, a flow of fluid into the blower assembly 15 when the atmospheric pressure outside the ventilation assembly 10 (i.e. within a vent or duct of a home or other building structure to which the duct connector assembly 58 is fluidly coupled) is higher than the pressure within the space to be ventilated.

Some embodiments provide a ventilation assembly 10 that can be installed as a new, original equipment installation in a room or building where none had previously existed. In some other embodiments, the ventilation assembly 10 can replace a pre-existing ventilation system. In some further embodiments, the blower assembly 15 can be installed as a new, or a replacement ventilation system, and in some embodiments, the assembly 15 can replace an existing assembly 15. In some embodiments, the assembly 15 can be installed in a pre-existing cavity or housing 20 in a room or building in order to substantially reduce the level of noise emitted from the ventilation assembly 10 during operation. In some embodiments, the inclusion of either the discharge grid 65, or the scroll crescent 300, 305, or both within the ventilation assembly 10 as illustrated in FIG. 1A-1D, 3A, 3C, 10A, 10B, or 10C and described earlier, can at least partially reduce the level of noise emitted from the ventilation assembly 10 during operation, and therefore at least partially reduce the level of audible noise emitted from the ventilation assembly 10. In some embodiments, the ventilation assembly 10 as illustrated in FIG. 1A-1D, 3A, 3C, 10A, 10B, or 10C and described earlier can reduce the audible noise emitted from the ventilation assembly 10 and therefore reduce the level of audible noise perceived by one or more individuals within the area to be ventilated, or an adjacent room or space.

Figure 11:
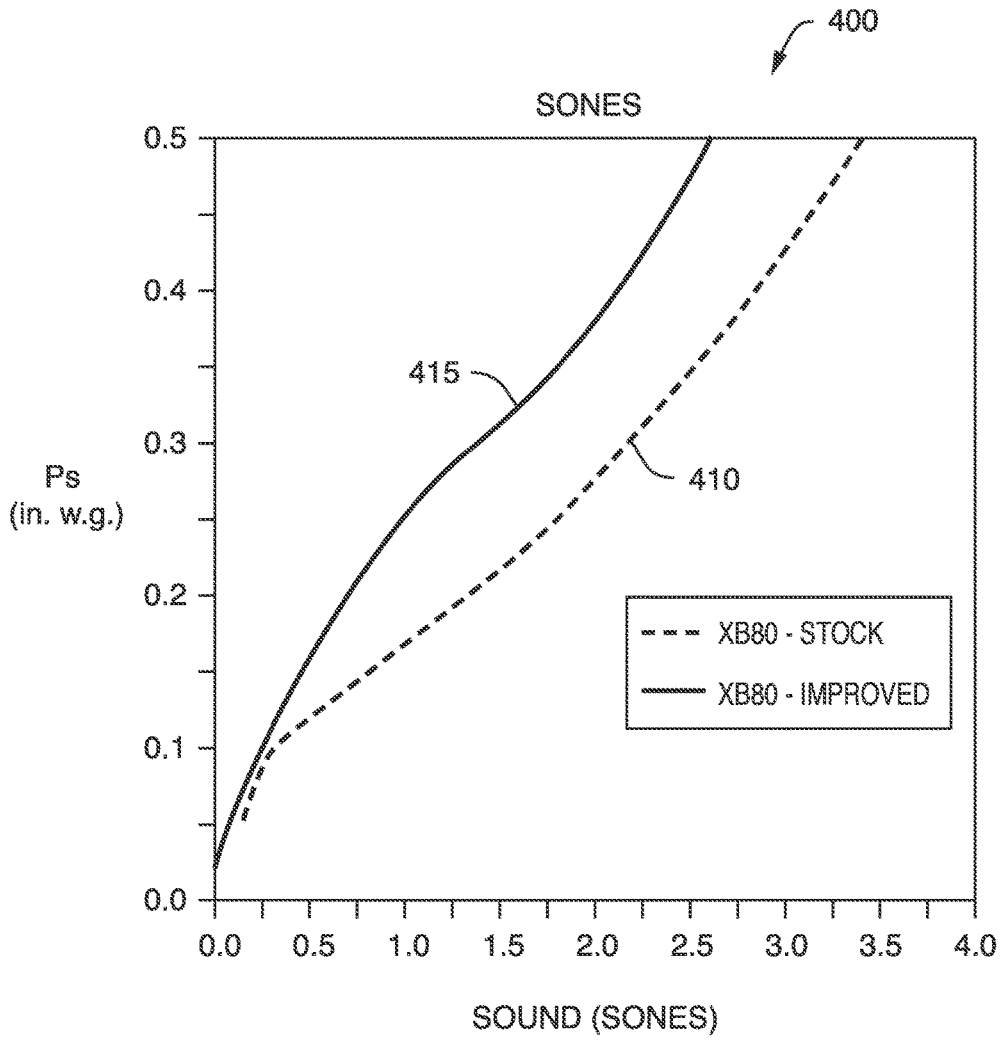
FIG. 11 shows a graph of noise level as a function of noise pressure for a conventional ventilation assembly versus the ventilation assembly according to one embodiment of the invention.

In some embodiments, the ventilation assembly 10 including discharge grid 65 and scroll crescent 300,305 as described earlier and illustrated in various embodiments shown at least in FIGS. 1A-1D, 2A-2C, 3B-3C, 10A and 10B can reduce the level of audible noise emitted from the assembly 10. For example, FIG. 11 shows a graph 400 of noise level (SONES) as a function of pressure Ps (in.w.g) for a conventional ventilation assembly (plot 410) versus the ventilation assembly 10 (plot 415) according to one embodiment of the invention. As shown, the ventilation assembly 10 including improvements in accordance with some embodiments herein described provide significant reductions in noise level.

Figure 12B:
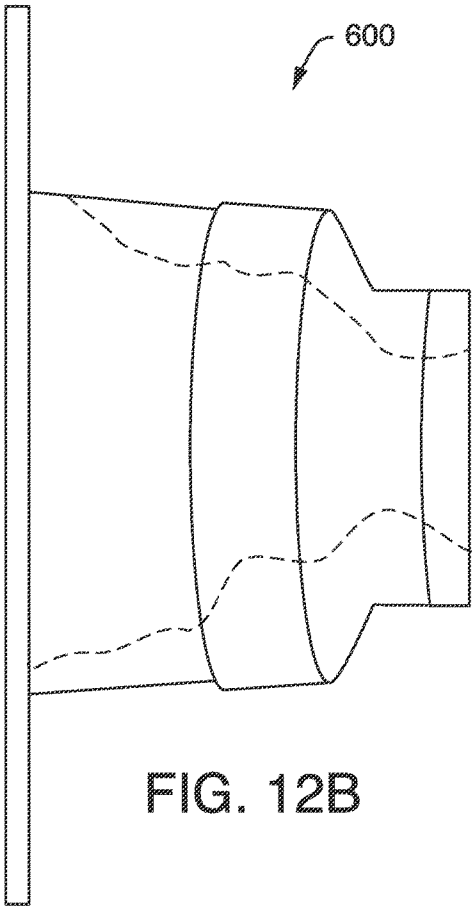
FIG. 12B illustrates a plot of a fluid dynamic simulation showing a velocity profile at a fan exit with fluid flow modifiers.
Figure 12A:
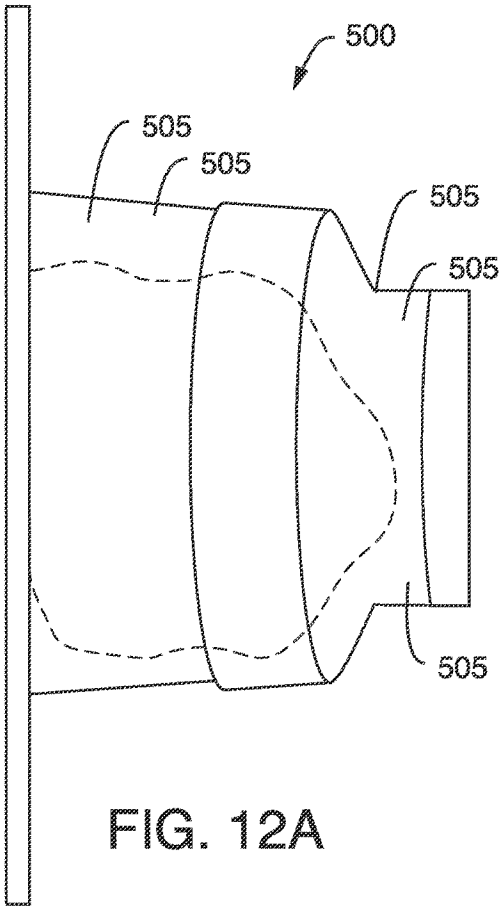
FIG. 12A illustrates a plot of a fluid dynamic simulation showing a velocity profile at a fan exit without fluid flow modifiers.

As described, some embodiments can include at least one component suitable for modifying a flow of fluid within the scroll assembly 25, which in some embodiments can include the addition of at least one component that can reduce noise creation with the main housing 20. By applying computer aided fluid dynamic calculations, it is possible to visualize the fluid velocity profile of a fluid within the ventilation assembly 10. For example, FIG. 12A illustrates a plot of a fluid dynamic simulation 500 showing a velocity profile at a fan exit (for example the discharge outlet 35) without fluid flow modifiers. As shown, the fluid dynamic simulation 500 includes substantially variable velocity profiles that include high velocity regions including vortices 505. Conversely, FIG. 12B illustrates a plot of a fluid dynamic simulation 600 showing a velocity profile at a fan exit with fluid flow modifiers. As shown, the fluid dynamic simulation 600 includes a velocity profile with minimal variation.

The plot of a fluid dynamic simulation 500 in FIG. 12A showing a velocity profile at a fan exit with substantially variable velocity profiles that include high velocity regions including vortices 505 provides an example where high pressure gradients may create fluid-induced noise. As shown, the fluid-induced noise may also create structure borne noise transmitted through the structural elements of the ventilation assembly 10. FIG. 12B illustrates that the inclusion of either the discharge grid 65, or the scroll crescent 300,305, or both, within the ventilation assembly 10 as illustrated in FIG. 1A-1D, 2A-2C, 3A, 3C, 10A, 10B, or 10C and described earlier, can at least partially reduce velocity gradients within the ventilation assembly 10, and therefore can at least partially reduce the level of noise emitted from the ventilation assembly 10 during operation.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A ventilation assembly, comprising:

a discharge grid for locating at a discharge outlet of a housing, the discharge grid including:

an outlet restriction comprising a restriction wall;

a first substantially vertical fin including a top edge and a bottom edge, wherein the bottom edge is configured to be located upstream of the top edge and the restriction wall extends from the bottom edge of the first substantially vertical fin to partially block a fluid from being discharged from the discharge outlet; and a first substantially horizontal fin extending from the first substantially vertical fin;

wherein the first substantially vertical fin and the first substantially horizontal fin form at least a portion of at least one aperture through which fluid may be discharged from the discharge outlet.

2. The ventilation assembly of claim 1, wherein the discharge grid further includes a main wall having a first end and a second end, the main wall extending from the restriction wall and a base wall coupled to the second end of the main wall and the bottom edge of the first substantially vertical fin.

3. The ventilation assembly of claim 1, wherein both the bottom edge of the first substantially vertical fin and the restriction wall are located upstream of the discharge outlet.

4. The ventilation assembly of claim 1 further comprising a duct connector assembly for being located at the discharge outlet.

5. A ventilation assembly comprising:

a scroll housing including an inner scroll surface and a discharge outlet, the discharge outlet formed between a first and second wall of the inner scroll surface;

a discharge grid for being coupled to the scroll housing, the discharge grid comprising:

a first substantially vertical fin including a top edge and a bottom edge wherein the bottom edge is configured to be located upstream of the top edge;

a restriction wall extending from the bottom edge of the first substantially vertical fin to partially block the fluid from being discharged from the discharge outlet;

a first substantially horizontal fin extending from the first substantially vertical fin; and wherein the first substantially horizontal fin and the first substantially vertical fin at least partially define at least one aperture; and a blower assembly including a motor coupled to a blower wheel; a scroll crescent substantially adjacent the inner scroll surface.

6. The ventilation assembly of claim 5, wherein the discharge grid further includes a main wall coupled to the restriction wall, the main wall including a first end and a second end and a first and second surfaces a base wall coupled to the second end of the main wall and the bottom edge of the first substantially vertical fin.

7. The ventilation assembly of claim 6, wherein the discharge grid further includes a flange coupled to the main wall.

8. The ventilation assembly of claim 7, wherein the discharge grid further includes at least one coupling pin.

9. The ventilation assembly of claim 8, wherein the discharge grid is configured and arranged to be coupled to the scroll by coupling the at least one coupling pin with at least one scroll pin coupling hole.

10. The ventilation assembly of claim 9, wherein the discharge grid includes at least one fastener coupling hole and the scroll includes at least one scroll fastener coupling hole.

11. The ventilation assembly of claim 10, wherein the discharge grid is further configured and arranged to be coupled to the scroll using at least one fastener secured through the at least one fastener coupling hole and through at least one scroll fastener coupling hole.

12. The ventilation assembly of claim 6, wherein the scroll includes at least one vertical slot and at least one snap slot; and a flange coupled to the main wall and a base wall coupled to the second end of the main wall and the bottom edge of the first substantially vertical fin, the flange including a coupling edge including at least one snap tab and the base wall includes at least one snap tab; and wherein the discharge grid is secured to the scroll by coupling the at least one snap tab with the at least one snap slot and coupling the coupling edge with the vertical slot.

13. The ventilation assembly of claim 5, wherein the scroll crescent is integrally formed in the inner scroll surface of the scroll housing.

14. The ventilation assembly of claim 5, wherein the scroll crescent comprises a discrete component coupled to the inner scroll surface of the scroll housing.

15. The ventilation assembly of claim 5, wherein at least a portion of the first substantially vertical fins includes a flared surface.

16. The ventilation assembly of claim 15, wherein the flared surface comprises:

a flare bottom surface comprising a flare bottom length, the flare bottom surface being at least partially curved; and a flare top surface comprising a flare top length, the flare top surface being at least partially curved.

17. The ventilation assembly of claim 16, wherein the flare top length and flare bottom length is substantially equal.

18. The ventilation assembly of claim 5, wherein at least a portion of at least one of the plurality of substantially horizontal fins includes a flared surface.

19. The ventilation assembly of claim 18, wherein the flared surface comprises:

a flare bottom surface comprising a flare bottom length, the flare bottom surface being at least partially curved; and a flare top surface comprising a flare top length, the flare top surface being at least partially curved.

20. The ventilation assembly of claim 19, wherein the flare top length and flare bottom length are unequal.

21. The ventilation assembly of claim 19, wherein the flare top length is less than the flare bottom length.

22. The ventilation assembly of claim 5, wherein the scroll crescent is positioned within the scroll housing so that the second crescent end is substantially 170° or less from the first wall of the inner scroll surface.

23. The ventilation assembly of claim 5, wherein the scroll crescent is positioned within the scroll housing so that a first crescent end is substantially at 90° from a first wall of the inner scroll surface, and a second crescent end is substantially at 180° from a first wall of the inner scroll surface.

24. The ventilation assembly of claim 5, wherein the first vertical fin and at least one the plurality of substantially horizontal fins form at least one substantially perpendicular intersection.

25. The ventilation assembly of claim 5, wherein the discharge grid is configured and arranged to guide air exiting the scroll housing in at least two different directions.

26. The ventilation assembly of claim 5, wherein both the bottom edge of the first substantially vertical fin and the restriction wall are located upstream of the discharge outlet.

27. The ventilation assembly of claim 5, further comprising a duct connector assembly for being located at the discharge outlet.

28. A ventilation assembly comprising:

a housing defining a discharge outlet through which fluid may be discharged from the housing;

a discharge grid for location at the discharge outlet, the discharge grid comprising:

a first fin for extending at least partially across the discharge outlet defining a top edge and a bottom edge, wherein the bottom edge is configured to be located upstream of the top edge;

a restriction wall extending from the bottom edge of the first fin to partially block the fluid from being discharged from the discharge outlet;

wherein both the bottom edge of the first fin and the restriction wall are located upstream of the discharge outlet.

29. The ventilation assembly of claim 28, further comprising a second fin for extending at least partially across the discharge outlet such that the first fin is oriented substantially perpendicular to the second fin.

30. The ventilation assembly of claim 29, further comprising a third fin substantially parallel to the second fin.

31. The ventilation assembly of claim 30, wherein the first fin, second fin and third fin all combine to at least partially define at least one aperture and the restriction wall blocks the fluid discharge through the at least one aperture.

32. The ventilation assembly of claim 29, wherein the first fin and second fin at least partially define at least one aperture and the restriction wall blocks fluid discharge through the at least one aperture.

33. The ventilation assembly of claim 28, further comprising a duct connector assembly for being located at the discharge outlet.

34. A discharge grid for location at a discharge outlet defined in a housing of a ventilation assembly, the discharge grid comprising:

a first fin for extending at least partially across the discharge outlet defining a top edge and a bottom edge, wherein the bottom edge is configured to be located upstream of the top edge;

a restriction wall extending from the bottom edge of the first fin to partially block the fluid from being discharged from the discharge outlet;

wherein both the bottom edge of the first fin and the restriction wall are configured to be located upstream of the discharge outlet.

35. The discharge grid of claim 34, further comprising a second fin for extending at least partially across the discharge outlet such that the first fin being oriented substantially perpendicular to the second fin.

36. The discharge grid of claim 35, further comprising a third fin substantially parallel to the second fin.

37. The ventilation assembly of claim 34, further comprising a duct connector assembly for being located at the discharge outlet.

38. A ventilation assembly comprising:

a scroll housing including an inner scroll surface and a discharge outlet defined at least partially by a first wall and a second wall opposing the first wall, each of the first and second walls extending from a top of the discharge outlet to a bottom of the discharge outlet;

a discharge grid for being located at the discharge outlet, the discharge grid comprising:

a restriction wall, the restriction wall for extending:

from adjacent one of the first and second opposing walls into the discharge outlet and inward within the scroll housing toward a blower wheel; and substantially between the top and bottom of the discharge outlet.

39. A ventilation assembly comprising:

a scroll housing including an inner scroll surface and a discharge outlet defined at least partially by a first wall and a second wall opposing the first wall, each of the first and second walls extending from a top of the discharge outlet to a bottom of the discharge outlet;

a discharge grid for being located at the discharge outlet, the discharge grid comprising:

a restriction wall, the restriction wall for extending:

from adjacent one of the first and second opposing walls into the discharge outlet to a first substantially vertically oriented fin extending within the discharge outlet; and substantially between the top and bottom of the discharge outlet.

40. The ventilation assembly of claim 39, the restriction wall connects with an upstream end of the first substantially vertically oriented fin.

* * * * *